US009212454B2

(12) United States Patent
Yanobu et al.

(10) Patent No.: US 9,212,454 B2
(45) Date of Patent: Dec. 15, 2015

(54) BRANCHING DEVICE AND CENTER GUIDE-TYPE TRACK-BASED TRANSPORTATION SYSTEM

(75) Inventors: Yukihide Yanobu, Tokyo (JP); Hiroyuki Kono, Tokyo (JP); Toshiaki Asanoma, Tokyo (JP); Yoshinobu Murakami, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 243 days.

(21) Appl. No.: 13/878,794

(22) PCT Filed: Feb. 27, 2012

(86) PCT No.: PCT/JP2012/054738

§ 371 (c)(1),
(2), (4) Date: Apr. 11, 2013

(87) PCT Pub. No.: WO2012/118004

PCT Pub. Date: Sep. 7, 2012

(65) Prior Publication Data

US 2013/0193278 A1 Aug. 1, 2013

(30) Foreign Application Priority Data

Feb. 28, 2011 (JP) ..... 2011-042313

(51) Int. Cl.

| | |
|---|---|
| ***E01B 25/28*** | (2006.01) |
| ***E01B 7/00*** | (2006.01) |
| ***B61B 13/00*** | (2006.01) |

(52) U.S. Cl.

CPC . *E01B 7/00* (2013.01); *B61B 13/00* (2013.01); *E01B 25/28* (2013.01)

(58) Field of Classification Search

CPC ..... B61L 5/10; B61L 5/00; B61L 23/005; E01B 25/28; E01B 25/00; E01B 7/02; E01B 2202/027; E01B 25/12; E01B 7/20; E01B 2202/024; E01B 2202/08

USPC ..... 246/448; 104/130.01, 130.06, 130.09

See application file for complete search history.

(56) References Cited

U.S. PATENT DOCUMENTS 1,740,365 A * 12/1929 Maves et al. ..... 246/448
2,177,802 A * 10/1939 Ferguson ..... 246/448

(Continued)

FOREIGN PATENT DOCUMENTS

CN 2414100 1/2001
CN 2637540 9/2004

(Continued)

OTHER PUBLICATIONS

Korean Office Action issued Nov. 3, 2014 in corresponding Korean Patent Application No. 10-2013-7012875 with English translation.

(Continued)

*Primary Examiner* — Mark Le

(74) *Attorney, Agent, or Firm* — Wenderoth, Lind & Ponack, L.L.P.

(57) ABSTRACT

A main line movable rail is disposed between a near-side main line rail and a forward-side main line rail which are disposed as a center guide rail so as to sandwich a branching section. The main line movable rail is supported so as to swing at the center of a first end at a position at which the first end is continuous to the forward-side main line rail. A locking action mechanism allows a second end of the main line movable rail to be engaged with an engagement member, thereby locking the second end so as not to undergo displacement at a guide position at which the second end of the main line movable rail is continuous to the near-side main line rail.

8 Claims, 22 Drawing Sheets

(56) References Cited

U.S. PATENT DOCUMENTS

| | | | | |
|---|---|---|---|---|
| 2,439,020 | A * | 4/1948 | Nell | 246/401 |
| 5,222,700 | A * | 6/1993 | Kais et al. | 246/443 |
| 5,312,074 | A * | 5/1994 | Keith et al. | 246/430 |
| 5,499,786 | A * | 3/1996 | Durchschlag et al. | 246/448 |
| 5,628,480 | A * | 5/1997 | Vrsecky et al. | 246/453 |
| 7,654,491 | B2 * | 2/2010 | Steinmann | 246/415 R |
| 2002/0157561 | A1 * | 10/2002 | Grunwald et al. | 104/130.01 |
| 2010/0270436 | A1 * | 10/2010 | Wientges et al. | 246/407 |

FOREIGN PATENT DOCUMENTS

| | | | |
|---|---|---|---|
| CN | 201459532 | | 5/2010 |
| CN | 101802306 | | 8/2010 |
| CN | 101821455 | | 9/2010 |
| GB | 1 571 523 | * | 12/1976 |
| GB | 2 166 102 | * | 4/1986 |
| JP | 49-140802 | | 12/1974 |
| JP | 55-126601 | | 9/1980 |
| JP | 58-66 | | 1/1983 |
| JP | 59-154202 | | 9/1984 |
| JP | 59-233001 | | 12/1984 |
| JP | 60-212502 | | 10/1985 |
| JP | 63-39722 | | 8/1988 |
| JP | 2-209501 | | 8/1990 |
| JP | 2-60801 | | 12/1990 |
| JP | 3-21681 | | 3/1991 |
| JP | 6-1402 | | 1/1994 |
| JP | 10-8403 | | 1/1998 |
| JP | 2563293 | | 2/1998 |
| JP | 2000-233748 | | 8/2000 |
| JP | 2006-205945 | | 8/2006 |
| KR | 10-2009-0037858 | | 4/2009 |
| MX | PA01009185 | | 6/2002 |

OTHER PUBLICATIONS

Japanese Office Action issued Nov. 11, 2014 in corresponding Japanese Patent Application No. 2011-042313 with English translation.

International Search Report issued May 29, 2012 in International (PCT) Application No. PCT/JP2012/054738, with English translation.

Written Opinion of the International Searching Authority issued May 29, 2012 in International (PCT) Application No. PCT/JP2012/054738, with English translation.

Chinese Office Action issued Sep. 1, 2014 in corresponding Chinese Patent Application No. 201280003702.4 with partial English translation.

* cited by examiner

BRANCHING DEVICE AND CENTER GUIDE-TYPE TRACK-BASED TRANSPORTATION SYSTEM

TECHNICAL FIELD

The present invention relates to a center guide-type track-based transportation system which is provided with a traveling lane and fixed rails disposed at the center of the traveling lane in a width direction of the traveling lane so as to sandwich a branching section, and to a branching device which guides a track-based vehicle traveling between the fixed rails of the track-based transportation system.

The present application claims the right of priority to Japanese Patent Application No. 2011-042313 filed on Feb. 28, 2011, in Japan, with the content cited herewith.

BACKGROUND ART

In recent years, as a new transportation mode other than buses and railways, a vehicle with running wheels composed of rubber tires that is designed to travel along a center guide rail has been known.

A branching device of a track-based transportation system equipped with the center guide rail, that is, a new center guide-type transportation system includes, for example, the device disclosed in Patent Document 1 shown below.

This branching device is provided with a movable traveling lane, a movable rail and a switching mechanism. The movable traveling lane is installed at a branching section which is a part where a main line intersects with a branch line and supported so as to move rotationally around a turning point. The movable rail is disposed at the center of the movable traveling lane. The switching mechanism allows the movable traveling lane and the movable rail to move in an integrated manner.

This switching mechanism allows the movable traveling lane and the movable rail to move in an integrated manner between a position at which the movable traveling lane and the movable rail are brought to a direction along the main line and a position at which the traveling lane and the center guide rail are brought to a direction along the branch line.

PRIOR ART DOCUMENT

Patent Document

Patent Document 1: Japanese Published Unexamined Patent Application No. H2-209501

SUMMARY OF THE INVENTION

Problems to be Solved by the Invention

In the branching device disclosed in Patent Document 1 shown above, the movable traveling lane is supported at the turning point where rotational movement is mainly carried out. However, a rotationally movable end which is opposite to the turning point is not fixed due to the rotational movement between a position at which they are brought to a direction along the main line and a position at which they are brought to a direction along the branch line. Therefore, the end is cantilever-supported and may become unstable. In the branching device disclosed in Patent Document 1, the movable rail is fixed to the movable traveling lane and the movable rail is allowed to move together with the movable traveling lane. Therefore, the switching mechanism is not only dimensionally made large but also the switching mechanism is increased in energy consumption, which may result in increased initial costs and running costs.

On the other hand, the movable rail is independently allowed to move rotationally, thus making it possible to downsize the switching mechanism. However, where the movable rail is supported so as to move rotationally at the turning point, the switching mechanism is decreased in rigidity and becomes more unstable, which may result in deformation of the rail and the like.

Under these circumstances, an object of the present invention is to provide a branching device which is capable of stably supporting a movable rail, with initial costs and running costs kept low, and also to provide a center guide-type track-based transportation system which is equipped with the branching device.

Means for Solving the Problems

The present invention provides a branching device which guides a track-based vehicle traveling between fixed rails in a center guide-type track-based transportation system, the transportation system being equipped with a traveling lane and the fixed rails disposed so as to sandwich a branching section at the center of the traveling lane in a width direction of the traveling lane. The branching device includes: a movable rail of which a first end is positioned at a position continuous to one of the fixed rails, which is supported so as to swing around the first end, and which can be switched between a guide position at which a second end of the movable rail opposite to the first end is continuous to the other of the fixed rails and a retracted position at which the second end is different in position from the other of the fixed rails in the traveling lane width direction; an engagement member configured to be engaged with the movable rail at the guide position to restrain displacement of the movable rail; and a locking action mechanism configured to activate the engagement member so as to change between a locked state in which the engagement member is engaged with the movable rail at the guide position and an unlocked state in which the engagement member is released from the movable rail.

In the branching device, the engagement member restrains displacement of the movable rail which is supported so as to swing around the first end, by which the movable rail is supported at a position where the engagement member is engaged with the first end. Therefore, even if the movable rail is allowed to move by itself, it is possible to support the movable rail stably.

In the present invention, it is acceptable that the branching device is provided with a switching mechanism by which the movable rail is allowed to move between the guide position and the retracted position, wherein the locking action mechanism is provided with a conversion unit which converts a driving force of the switching mechanism to a driving force for activating the engagement member.

In this branching device, the driving force of the switching mechanism is used to activate the engagement member so as to change. This makes it possible to eliminate the need for an independent driving source and keep running costs low.

In the branching device, it is acceptable that the locking action mechanism is provided with a driving source which activates the engagement member so as to change between the locked state and the unlocked state.

This branching device does not need a complicated mechanism for converting the driving force of the switching mechanism to the driving force for activating the engagement member so as to change. It is therefore possible to keep initial costs low.

It is acceptable that in the branching device, the engagement member is supported so as to move rotationally around a rotational axis extending toward one of the fixed rails from the other, and is provided with a pair of projections which are capable of retaining the movable rail at the guide position in the width direction of the traveling lane, wherein the locking action mechanism allows the engagement member to move rotationally around the rotational axis, thereby activating the engagement member so as to change between the locked state in which the movable rail is retained between the pair of projections and the unlocked state in which the pair of projections are retracted from the movable rail.

In the above description, "the movable rail is retained between the pair of projections," "retained" refers to a state in which the movable rail is positioned between the pair of projections and the projections are in close proximity to the movable rail (not in contact) or in contact with each other. The meaning of "retained" is common in the description of the present application and also in an entire scope of claims.

It is acceptable that in the branching device, the engagement member is provided with a pair of projections which are capable of retaining the movable rail at the guide position in the traveling lane width direction, and at least one of the projections is supported so as to move rotationally around the rotational axis extending in a direction moving from one of the fixed rails toward the other, wherein the locking action mechanism allows at least one of the projections to move rotationally, thereby activating the engagement member so as to change between the locked state in which the movable rail is retained between the pair of projections and the unlocked state in which at least one of the projections is retracted from the movable rail.

It is acceptable that in the branching device, the engagement member is supported so as to be movable in a vertical direction which is perpendicular to a traveling lane surface on which the track-based vehicle travels, and is provided with a pair of projections which are capable of retaining the movable rail at the guide position in the traveling lane width direction, wherein the locking action mechanism allows the engagement member to move in the vertical direction, thereby activating the engagement member so as to change between the locked state in which the movable rail is retained between the pair of projections and the unlocked state in which the pair of projections are retracted from the movable rail.

It is acceptable that in the branching device, the engagement member is provided with a pair of projections which are capable of retaining the movable rail at the guide position in the traveling lane width direction, and at least one of the projections is supported so as to be movable in a vertical direction perpendicular to a traveling lane surface on which the track-based vehicle travels, wherein the locking action mechanism allows at least one of the projections to move in the vertical direction, thereby activating the engagement member so as to change between the locked state in which the movable rail is retained between the pair of projections and the unlocked state in which at least one of the projections is retracted from the movable rail.

It is acceptable that in the branching device, the engagement member is supported so as to move rotationally around a rotational axis extending in the traveling lane width direction, and is provided with a pair of projections which are capable of retaining the movable rail at the guide position in the traveling lane width direction, wherein the locking action mechanism allows the engagement member to move rotationally around the rotational axis, thereby activating the engagement member so as to change between the locked state in which the movable rail is retained between the pair of projections and the unlocked state in which the pair of projections are retracted from the movable rail.

It is acceptable that in the branching device, the engagement member is provided with a pair of projections which are capable of retaining the movable rail at the guide position in the width direction of the traveling lane, at least one of the projections is supported so as to move rotationally around a rotational axis extending in the traveling lane width direction, wherein the locking action mechanism allows at least one of the projections to move rotationally around the rotational axis, thereby activating the engagement member so as to change between the locked state in which the movable rail is retained between the pair of projections and the unlocked state in which at least one of the projections is retracted from the movable rail.

It is acceptable that in the branching device, the engagement member is supported so as to move rotationally around a rotational axis extending in a vertical direction perpendicular to a traveling lane surface, and is provided with a pair of projections of which the interval is greater than the width of the movable rail in the traveling lane width direction, wherein the locking action mechanism allows the engagement member to move rotationally around the rotational axis, thereby activating the engagement member so as to change between the locked state in which the pair of projections are in close to the movable rail at the guide position to retain the movable rail in the traveling lane width direction and the unlocked state in which the pair of projections are retracted from the movable rail.

It is acceptable that in the branching device, the engagement member is provided with a pair of projections which are capable of retaining the movable rail at the guide position in the width direction of the traveling lane, and at least one of the projections is supported so as to move in the traveling lane width direction, wherein the locking action mechanism allows at least one of the projections to move in the traveling lane width direction, thereby activating the engagement member so as to change between the locked state in which the movable rail is retained between the pair of projections and the unlocked state in which at least one of the projections is retracted from the movable rail.

It is acceptable that in the branching device, the engagement member is provided with a pair of projections which are capable of retaining the movable rail at the guide position in the width direction of the traveling lane, and at least one of the projections is supported so as to move in a direction moving toward one of the fixed rails from the other, wherein the locking action mechanism allows at least one of the projections to move in a direction moving toward one of the fixed rails from the other, thereby activating the engagement member so as to change between the locked state in which the movable rail is retained between the pair of projections and the unlocked state in which at least one of the projections is retracted from the movable rail toward the other of the fixed rails.

It is acceptable that in the branching device, the engagement member is provided with a pair of projections which are capable of retaining the movable rail at the guide position in the width direction of the traveling lane, and at least one of the projections is supported so as to move rotationally around a rotational axis extending in a vertical direction perpendicular to a traveling lane surface of the track-based vehicle, wherein the locking action mechanism allows at least one of the projections to move rotationally, thereby activating the engagement member so as to change between the locked state in which the movable rail is retained between the pair of projections and the unlocked state in which at least one of the projections is retracted from the movable rail.

It is acceptable that in the branching device, at least one of the projections of the engagement member is such that a part thereof including a face opposing the movable rail in the locked state is formed of an elastic material.

In this branching device, where there is a manufacturing error in width of the movable rail in the width direction of the traveling lane or where the movable rail is curved, at least a part of the elastic material is in contact with the movable rail to undergo elastic deformation. It is therefore possible to cope with the manufacturing error and the rail which is curved.

It is acceptable that in the branching device, at least a part of the movable rail retained between the pair of projections at the guide position is formed as a curved part, and the pair of projections of the engagement member is such that faces opposing the movable rail on retaining the movable rail positioned at the guide position are curved at a curvature in accordance with a curvature of the curved part.

In this branching device, it is possible to make substantially constant a clearance between the projections at each position of the guide face of the movable rail and also decrease the clearance between them.

It is acceptable that the branching device includes a plurality of locking mechanisms provided with the engagement member and the locking action mechanism, wherein the plurality of locking mechanisms are disposed along the movable rail positioned at the guide position.

Since this branching device is able to restrain the movable rail at a greater number of sites, it is possible to support the movable rail more stably.

It is acceptable that the branching device includes at least one of locking mechanisms provided with the engagement member and the locking action mechanism, wherein in the locked state, an end locking mechanism included in the locking mechanisms is positioned so as to engage with an end of the other of the fixed rails along with the second end of the movable rail at the guide position.

In this branching device, a step at a joint between the second end of the movable rail and the end of the other of the fixed rails is decreased, by which it is possible to give an improved ride quality to passengers. In addition, a force coming from a track-based vehicle is received by the other of the fixed rails together with the engagement member, thus making it possible to support the movable rail more firmly.

It is acceptable that in the branching device, the traveling lane is provided with a main line traveling lane and a branch line traveling lane which branches from the main line traveling lane, the other of the fixed rails is a near-side main line rail which is a fixed rail of the main line traveling lane disposed on a near side in a traveling direction from a branch starting position at which the branch line traveling lane starts to branch from the main line traveling lane, one of the fixed rails includes a forward-side main line rail which is a fixed rail of the main line traveling lane disposed via the branching section from the near-side main line rail along the main line traveling lane and a branch line rail which is a fixed rail of the branch line traveling lane disposed via the branching section from the main line traveling lane along the branch line traveling lane, the movable rail is provided with a main line movable rail disposed at a position at which the first end is continuous to the forward-side main line rail and a branch line movable rail disposed at a position at which the first end is continuous to the branch line rail, and the locking mechanism having the engagement member and the locking action mechanism is installed on each of the main line movable rail and the branch line movable rail.

It is acceptable that in the branching device, the traveling lane is provided with a main line traveling lane and a branch line traveling lane which branches from the main line traveling lane, the other of the fixed rails is a near-side main line rail which is a fixed rail of the main line traveling lane disposed on a near side in a traveling direction from a branch starting position at which the branch line traveling lane starts to branch from the main line traveling lane, one of the fixed rails includes a forward-side main line rail which is a fixed rail of the main line traveling lane disposed via the branching section from the near-side main line rail along the main line traveling lane and a branch line rail which is a fixed rail of the branch line traveling lane disposed via the branching section from the near-side main line traveling lane along the branch line traveling lane, the movable rail is provided with a main line movable rail disposed at a position at which the first end is continuous to the forward-side main line rail and a branch line movable rail disposed at a position at which the first end is continuous to the branch line rail, and the engagement member of the end locking mechanism is such that the pair of projections undergo displacement by the locking action mechanism of the end locking mechanism, and the engagement member is installed at a position at which engagement is made not only with the second end of the main line movable rail at the guide position in the locked state but also with the end of the near-side main line rail and engagement is made not only with the second end of the branch line movable rail at the guide position but also with the end of the near-side main line rail.

In this branching device, a single engagement member is used to restrain both the second end of the main line movable rail and the second end of the branch line movable rail, thus making it possible to keep initial costs low.

In order to solve the above-described problem, a center guide-type track-based transportation system is provided with the branching device, the traveling lane and the fixed rails.

This track-based transportation system is provided with the branching device, by which when a movable rail is allowed to move by itself, the movable rail can be supported stably.

Advantageous Effects of the Invention

In the present invention, when the movable rail and the traveling lane are not allowed to move in an integrated manner but the movable rail is allowed to move by itself, the movable rail can be supported stably. Therefore, according to the present invention, it is possible to suppress initial costs and running costs and also support the movable rail stably.

Figure 5A:
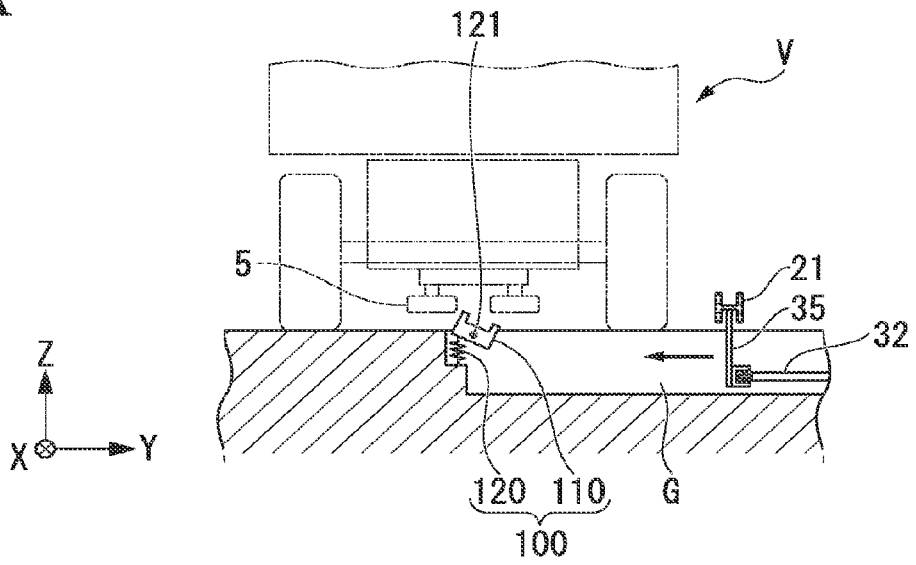
Figure 5B:
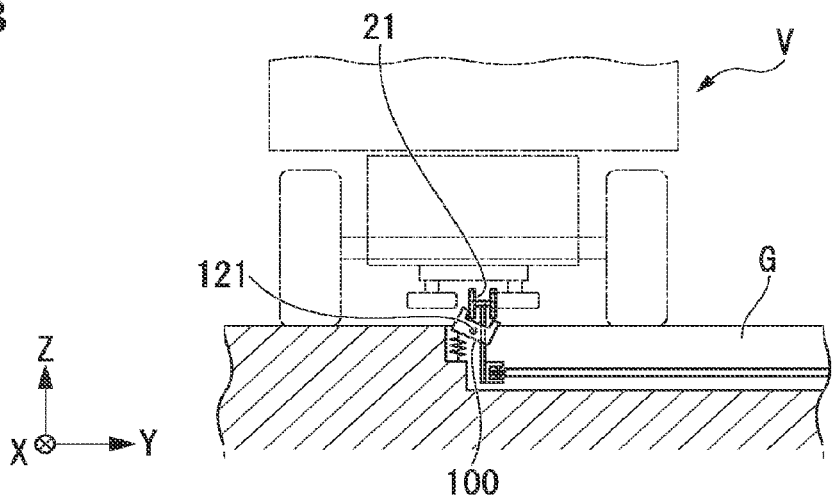
Figure 5C:
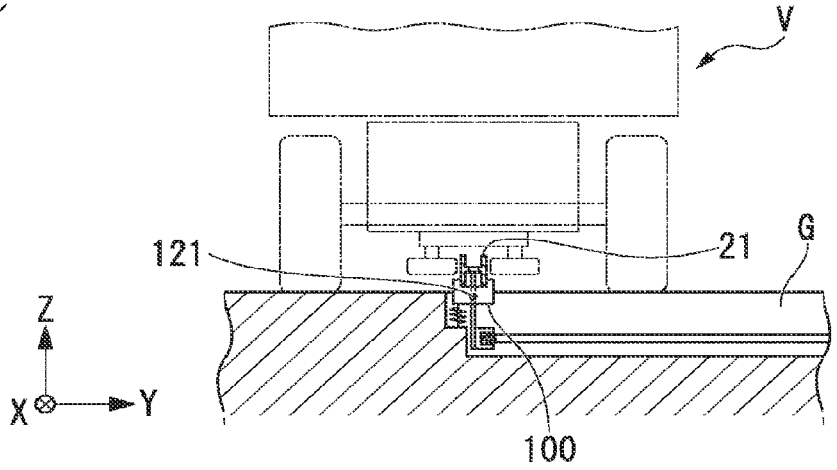

Each of FIGS. 5A to 5C is a view which briefly explains motion of a locking mechanism of a First Embodiment according to the present invention.

Figure 6A:
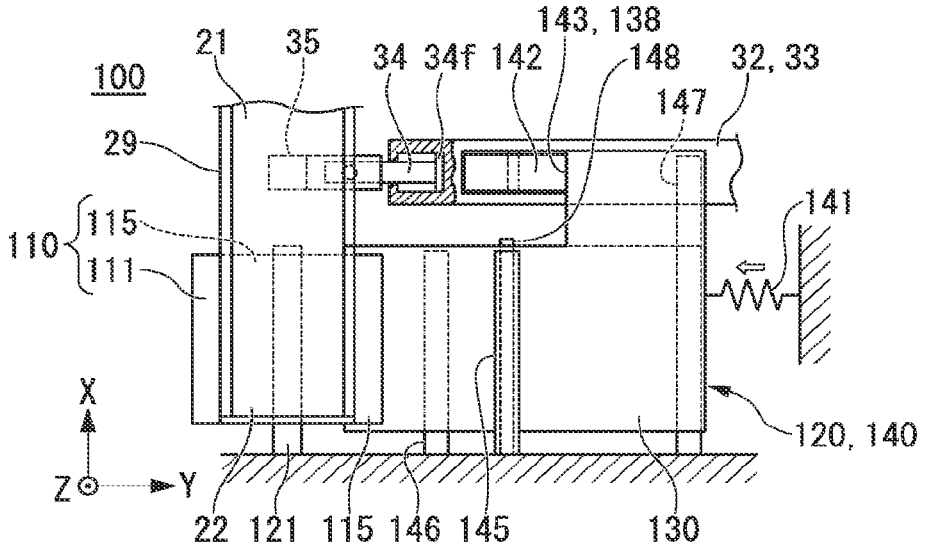
Figure 6B:
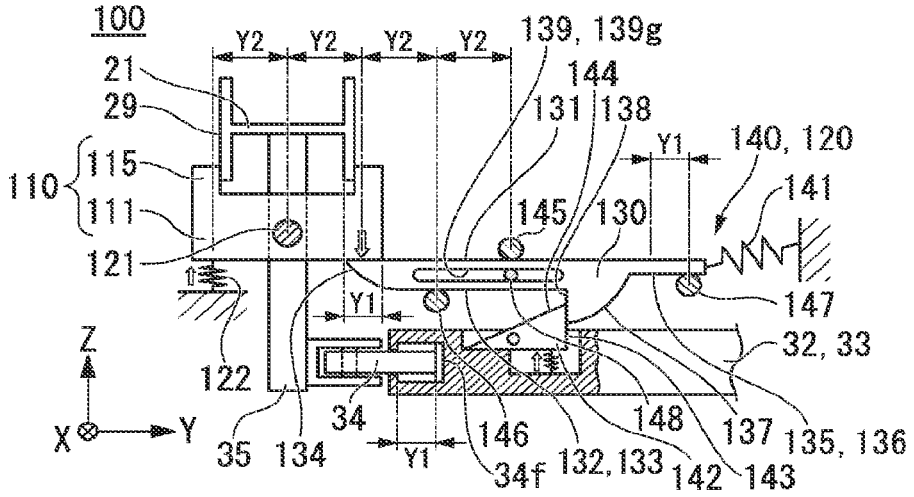
Figure 6C:
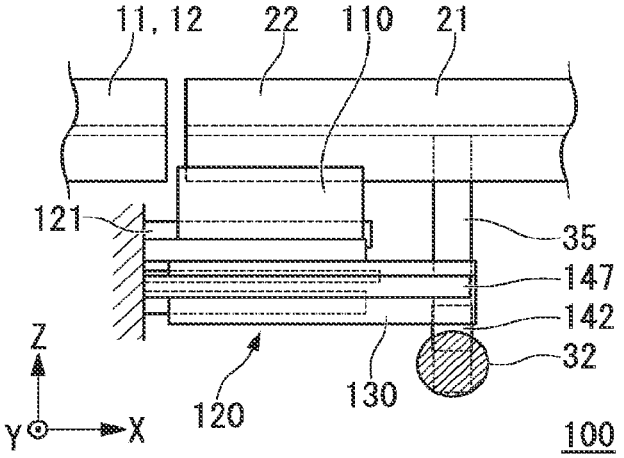

Each of FIGS. 6A to 6C is a view which shows a state in which the locking mechanism of the First Embodiment according to the present invention is locked.

Figure 7A:
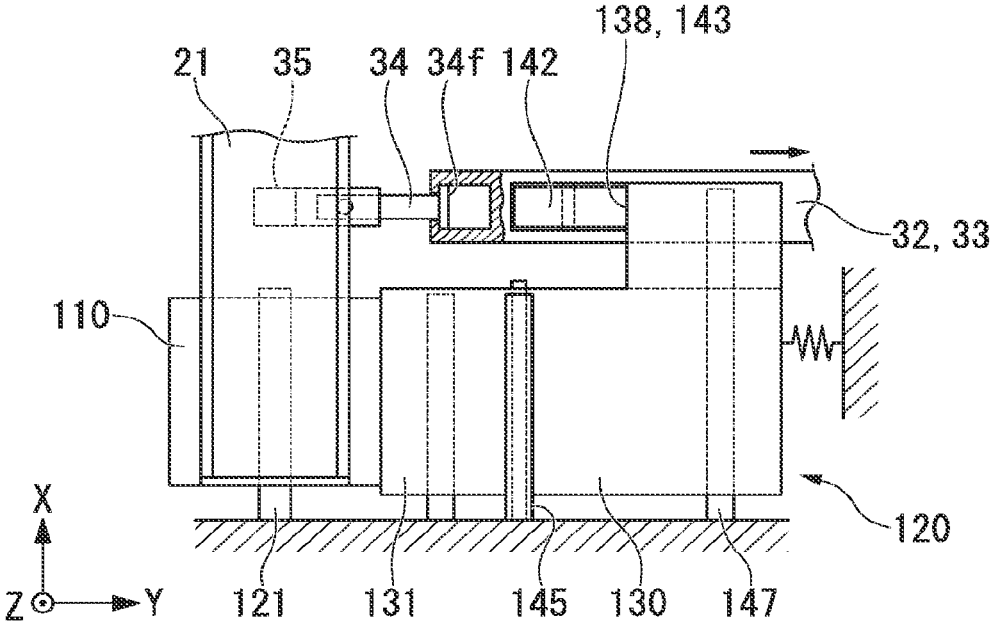
Figure 7B:
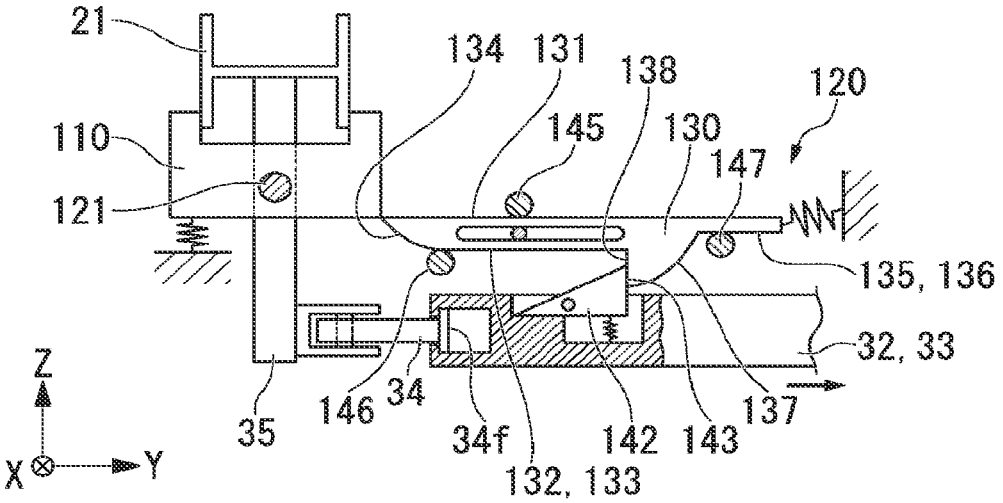

Each of FIGS. 7A and 7B is a view which shows a state in which the locking mechanism of the First Embodiment according to the present invention starts to be unlocked.

Figure 8A:
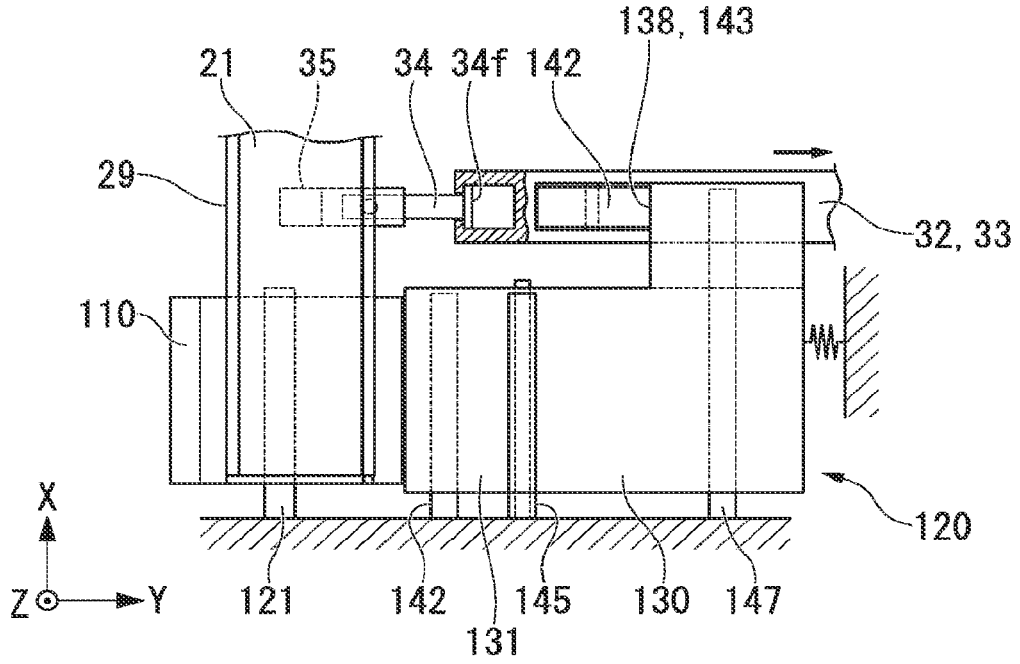
Figure 8B:
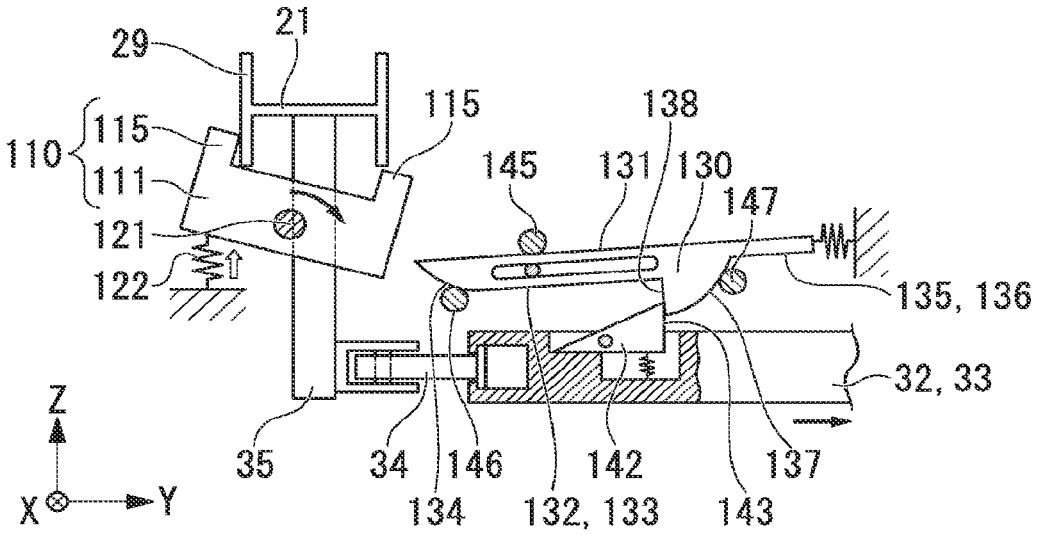

Each of FIGS. 8A and 8B is a view which shows a state in which the locking mechanism of the First Embodiment according to the present invention is unlocked.

Figure 9A:
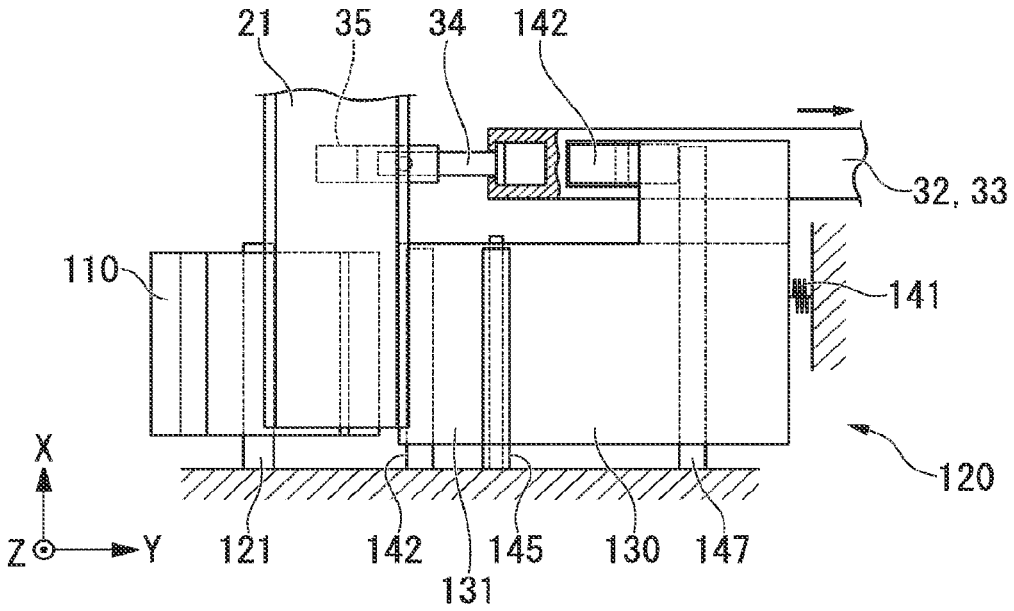
Figure 9B:
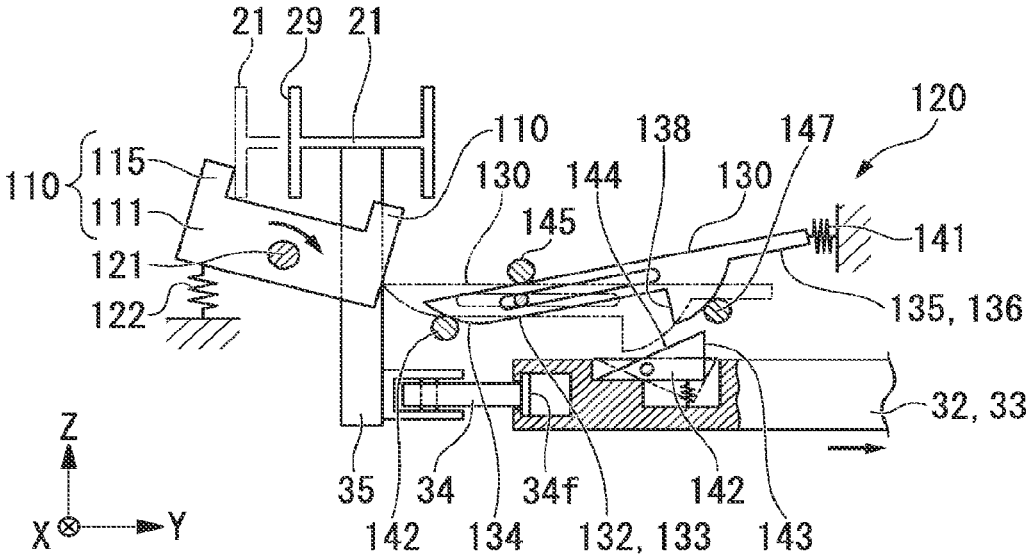

Each of FIGS. 9A and 9B is a view which shows an unlocked state of the locking mechanism of the First Embodiment according to the present invention.

Figure 10:
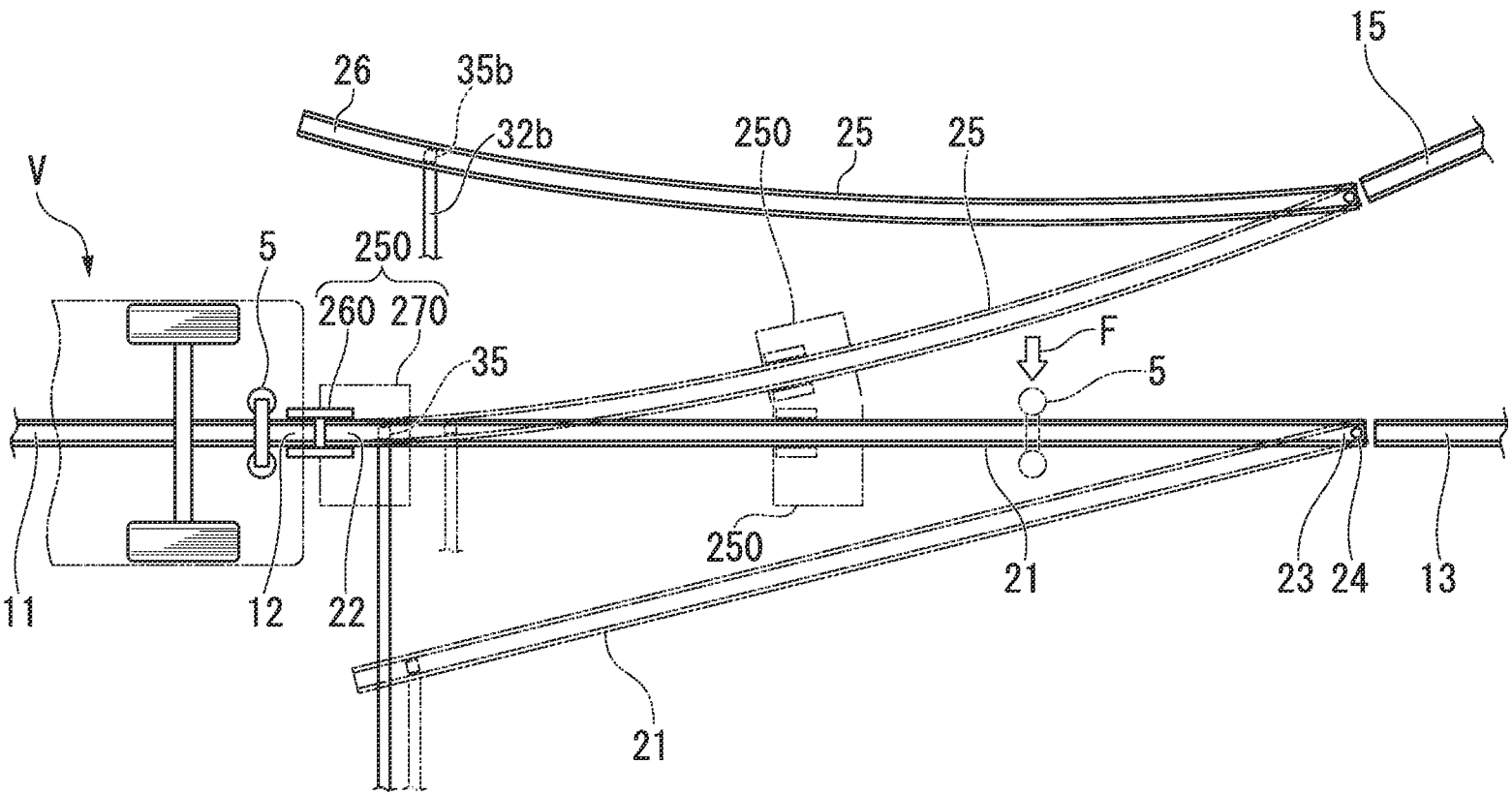

FIG. 10 is a plan view which shows a branching device of a Second Embodiment according to the present invention.

Figure 11A:
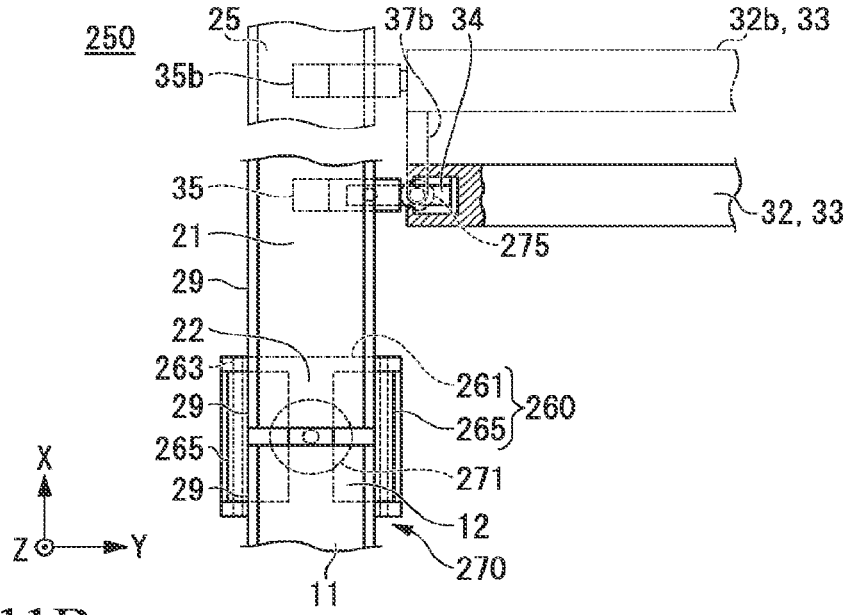
Figure 11B:
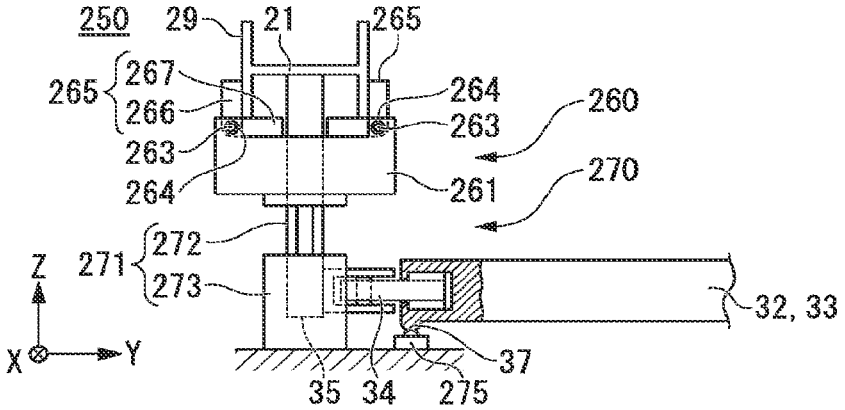
Figure 11C:
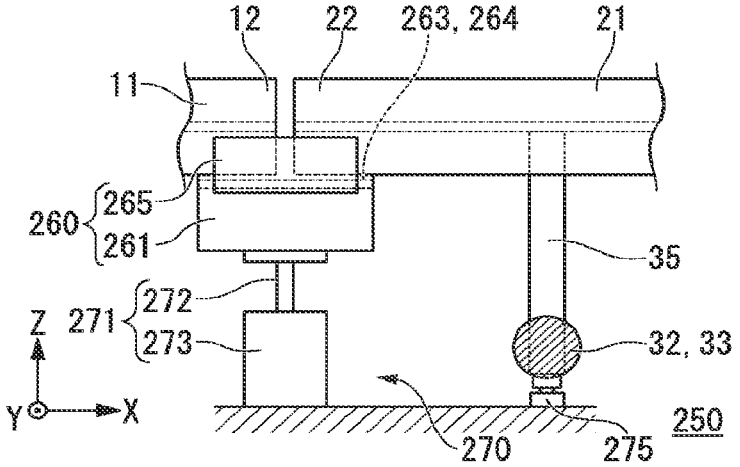

Each of FIGS. 11A to 11C is a view which shows a state in which the locking mechanism of the Second Embodiment according to the present invention is locked.

Figure 12A:
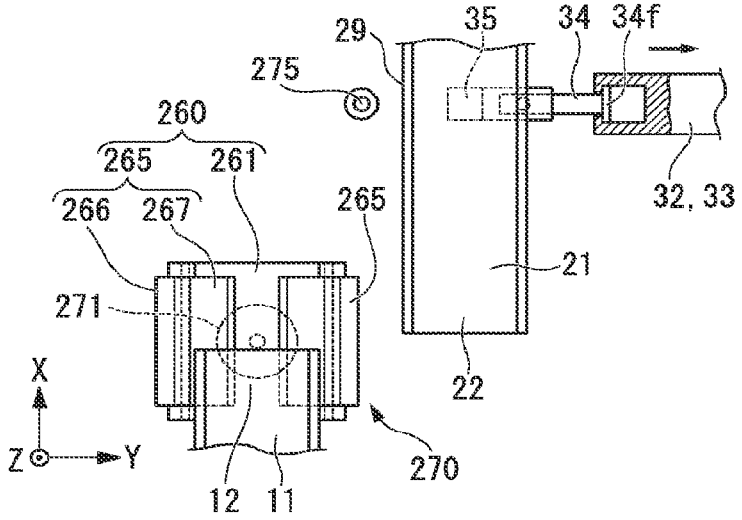
Figure 12B:
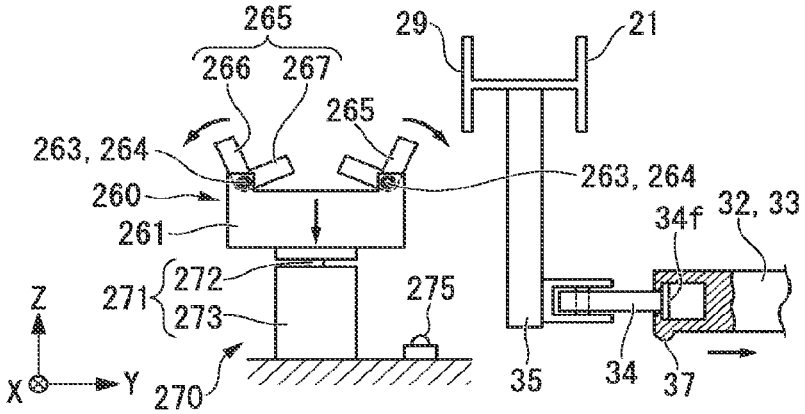
Figure 12C:
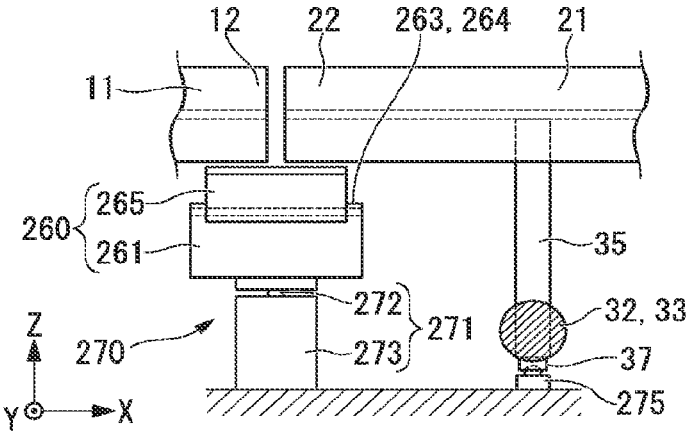

Each of FIGS. 12A to 12C is a view which shows an unlocked state of the locking mechanism of the Second Embodiment according to the present invention.

Figure 13A:
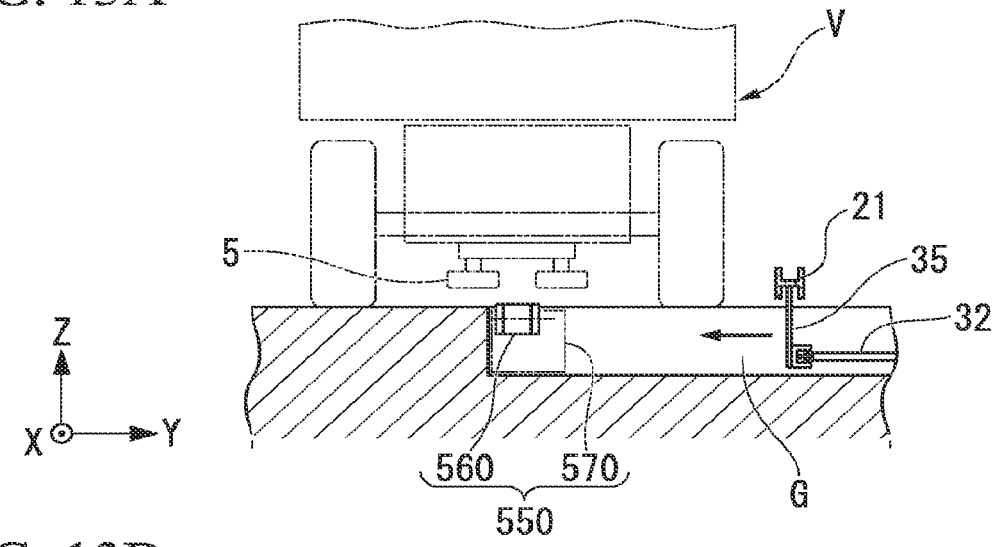
Figure 13B:
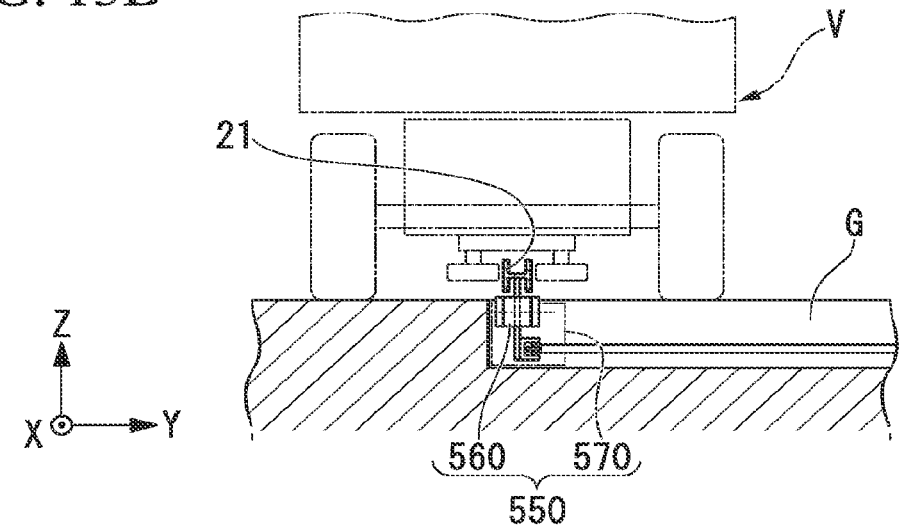
Figure 13C:
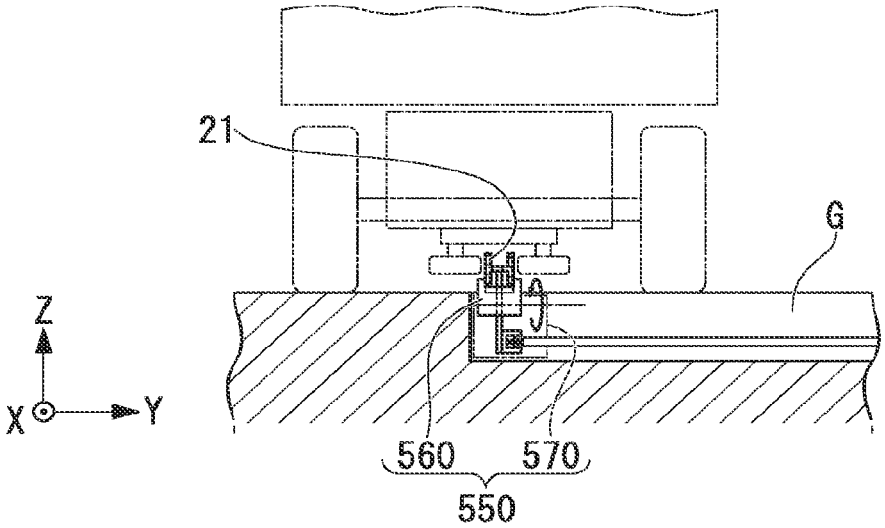

Each of FIGS. 13A to 13C is a view which briefly explains motion of a locking mechanism of a Third Embodiment according to the present invention.

Figure 14A:
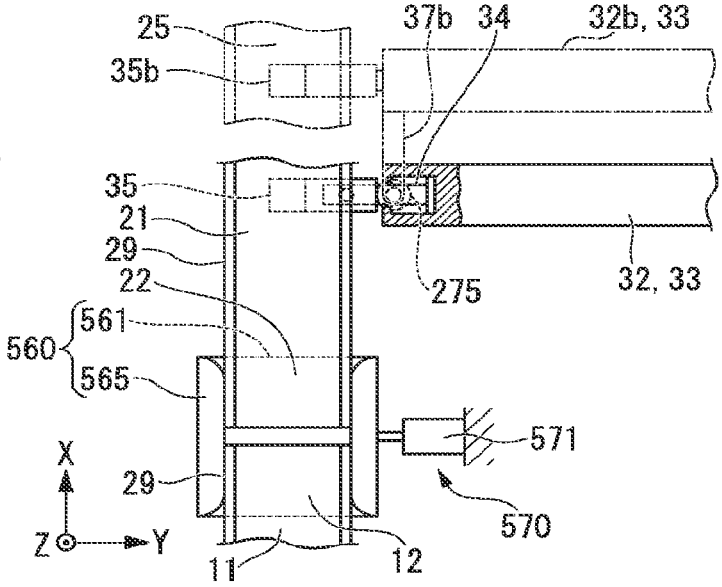
Figure 14B:
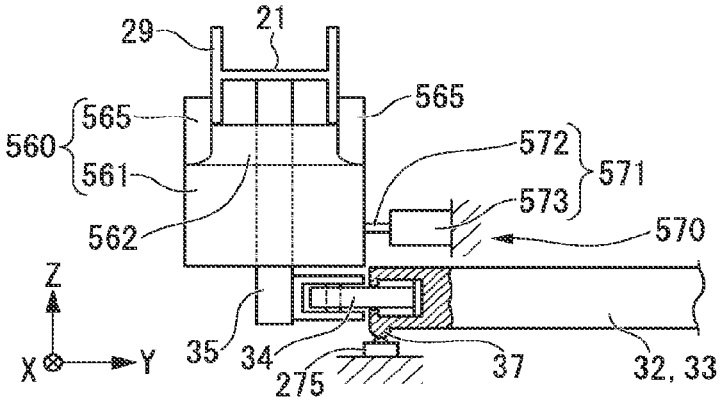
Figure 14C:
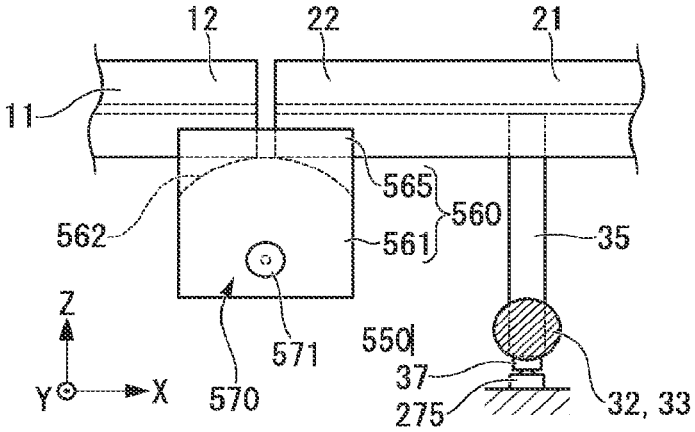

Each of FIGS. 14A to 14C is a view which shows a state in which the locking mechanism of the Third Embodiment according to the present invention is locked.

Figure 15A:
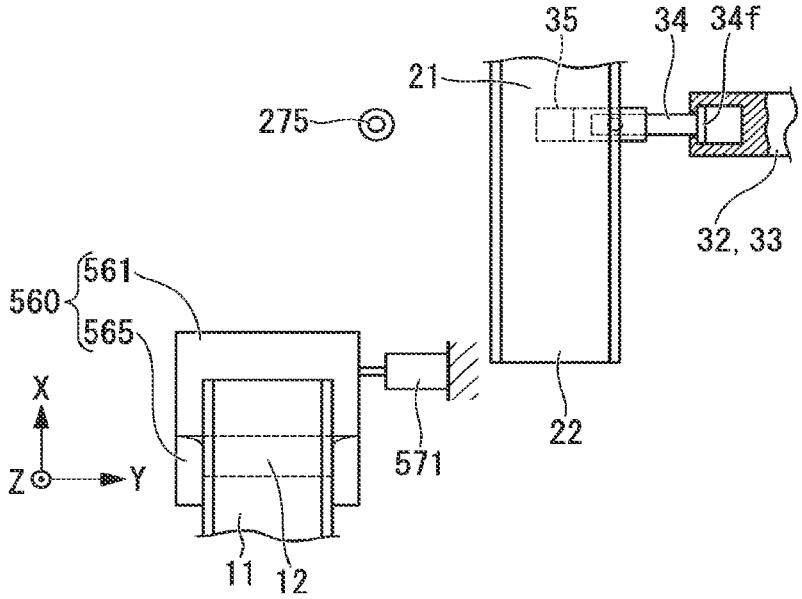
Figure 15B:
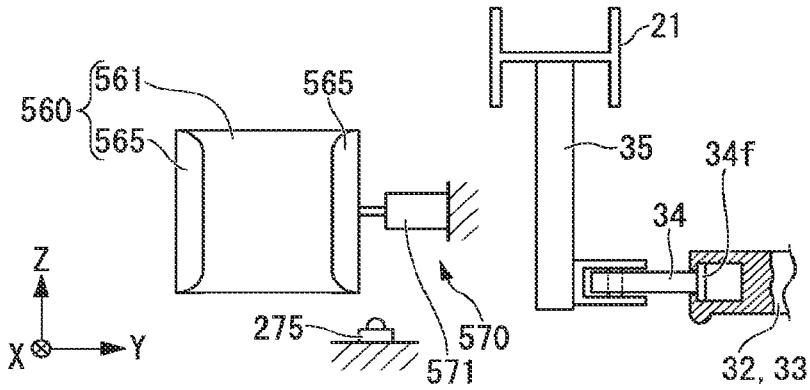
Figure 15C:
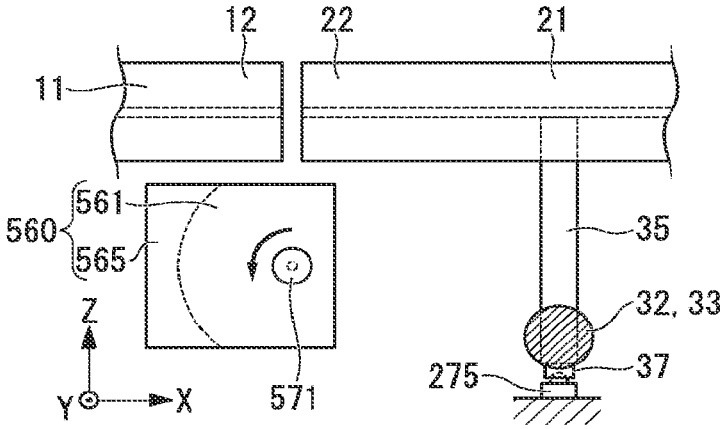

Each of FIGS. 15A to 15C is a view which shows an unlocked state of the locking mechanism of the Third Embodiment according to the present invention.

Figure 16A:
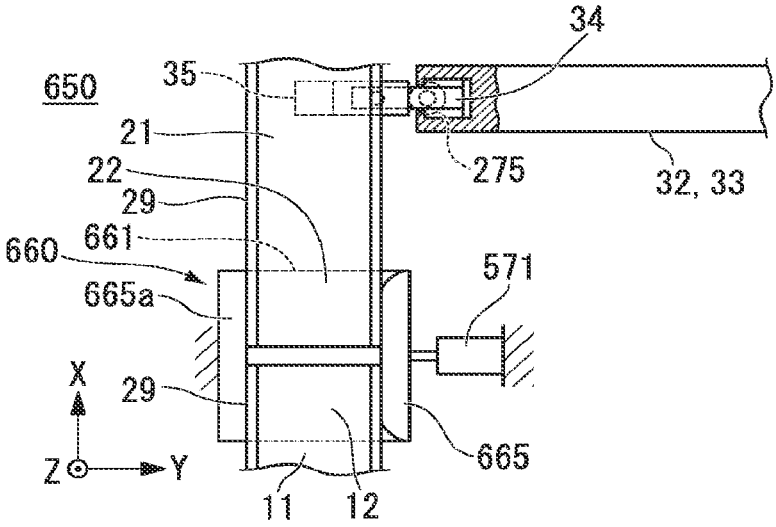
Figure 16B:
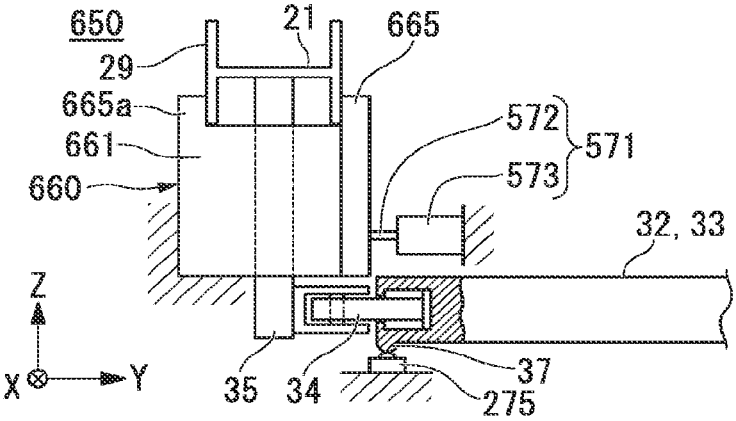
Figure 16C:
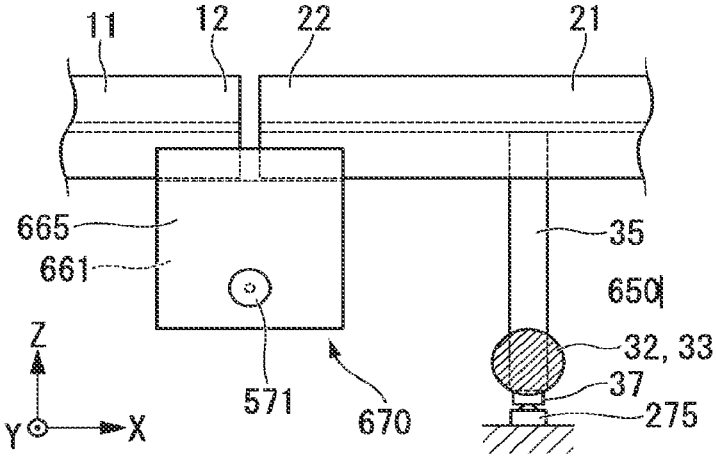

Each of FIGS. 16A to 16C is a view which shows a state in which a locking mechanism of a Fourth Embodiment according to the present invention is locked.

Figure 17A:
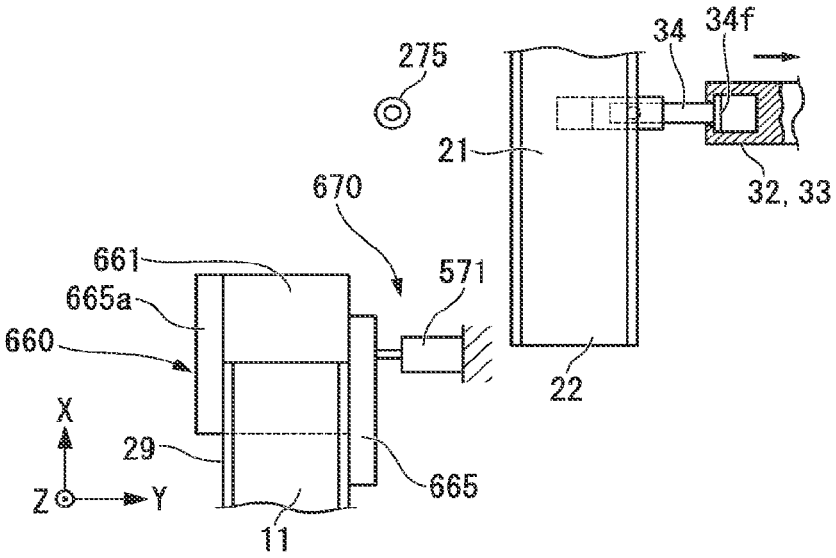
Figure 17B:
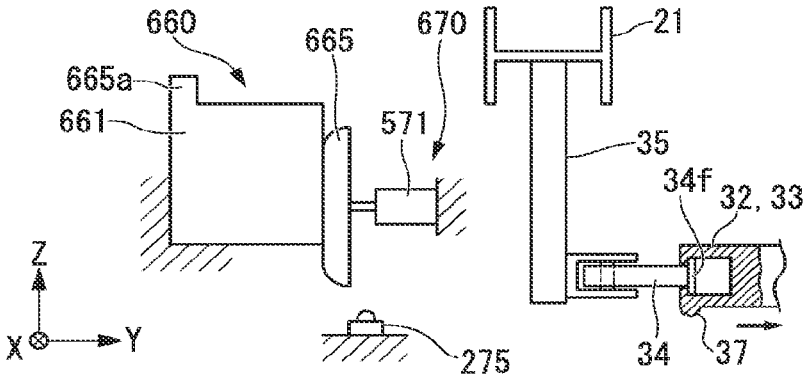
Figure 17C:
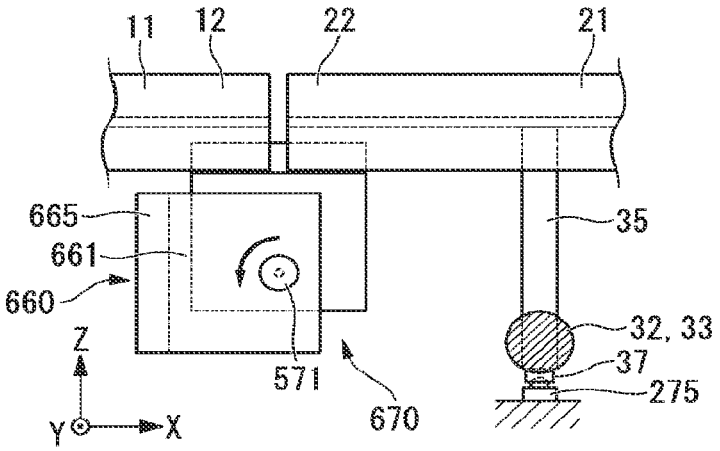

Each of FIGS. 17A to 17C is a view which shows an unlocked state of the locking mechanism of the Fourth Embodiment according to the present invention.

Figure 18A:
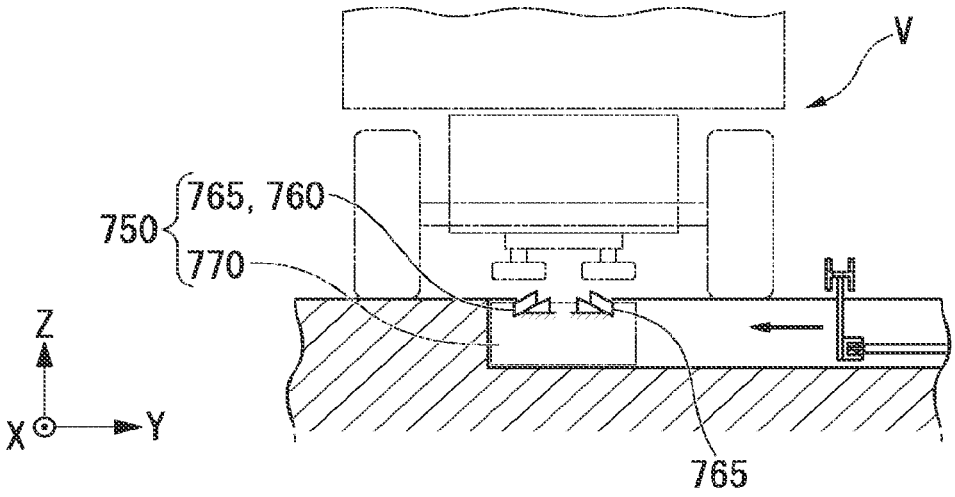
Figure 18B:
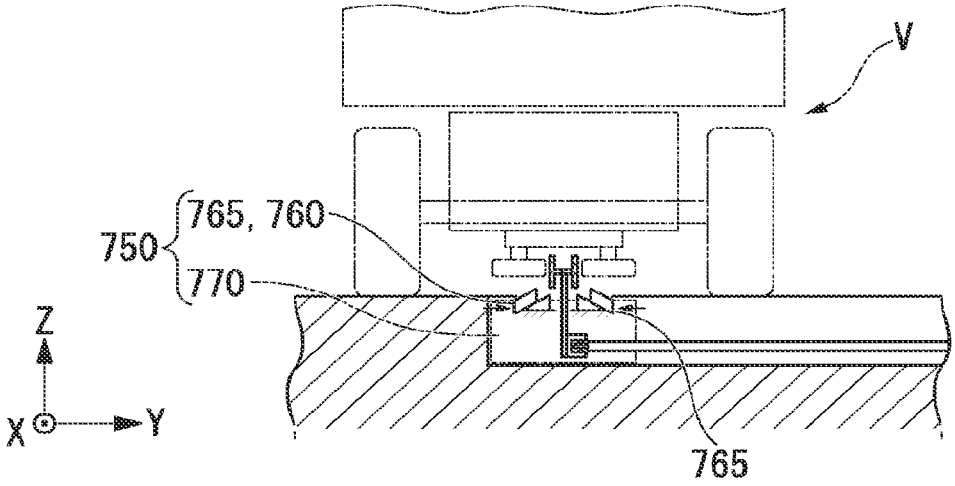
Figure 18C:
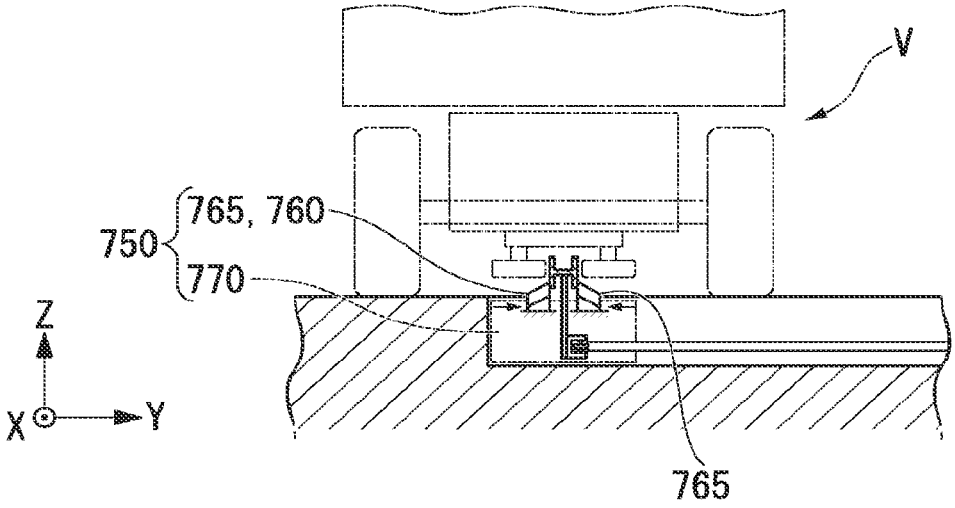

Each of FIGS. 18A to 18C is a view which briefly explains motion of a locking mechanism of a Fifth Embodiment according to the present invention.

Figure 19A:
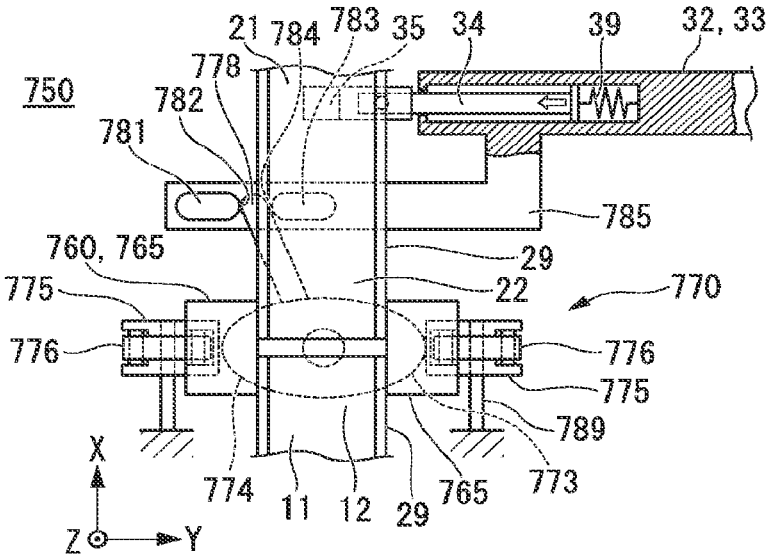
Figure 19B:
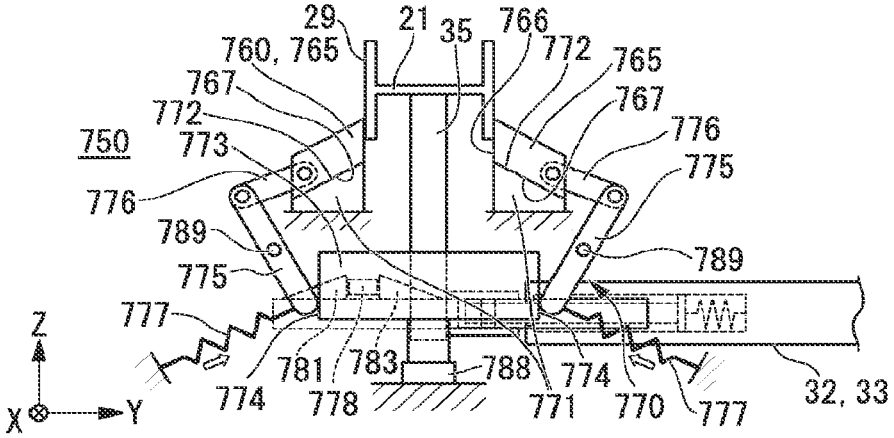
Figure 19C:
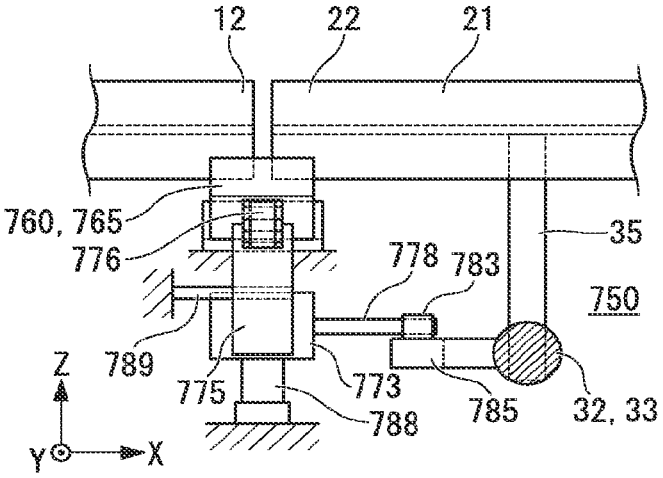

Each of FIGS. 19A to 19C is a view which shows a state in which the locking mechanism of the Fifth Embodiment according to the present invention is locked.

Figure 20A:
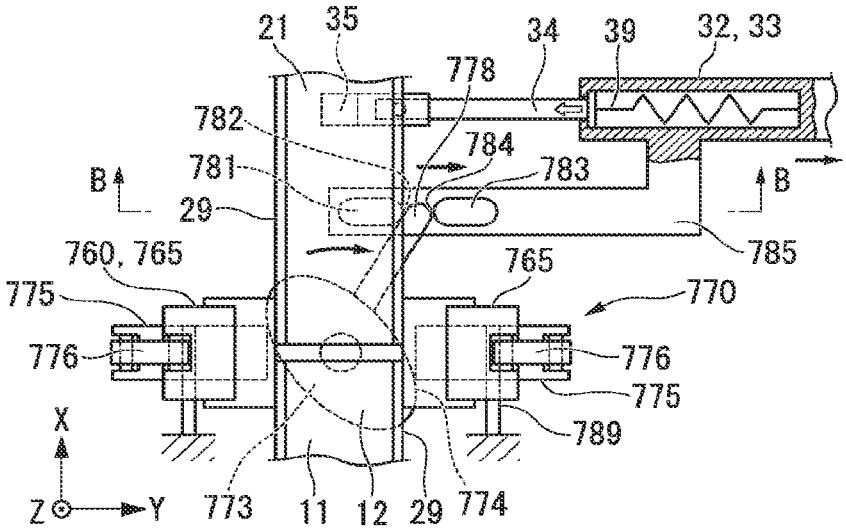
Figure 20B:
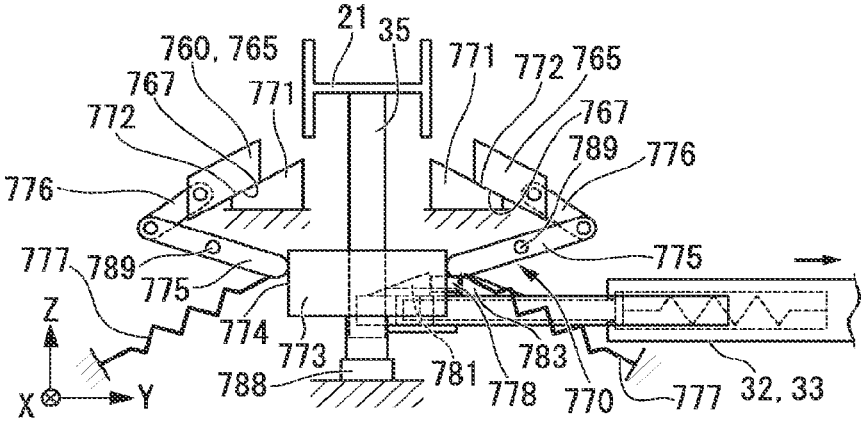
Figure 20C:
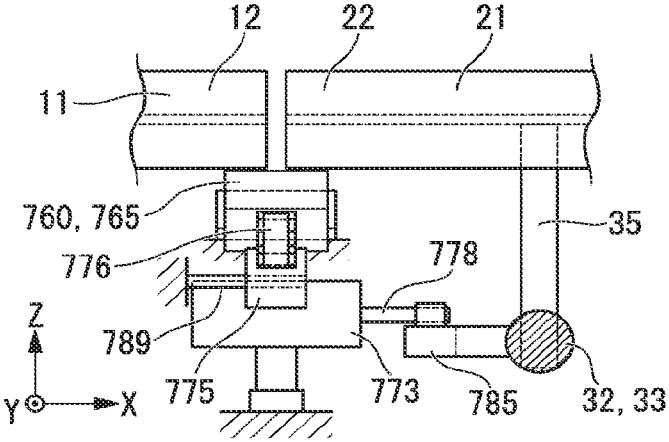

Each of FIGS. 20A to 20C is a view which shows a state in which the locking mechanism of the Fifth Embodiment according to the present invention is unlocked.

Figure 21A:
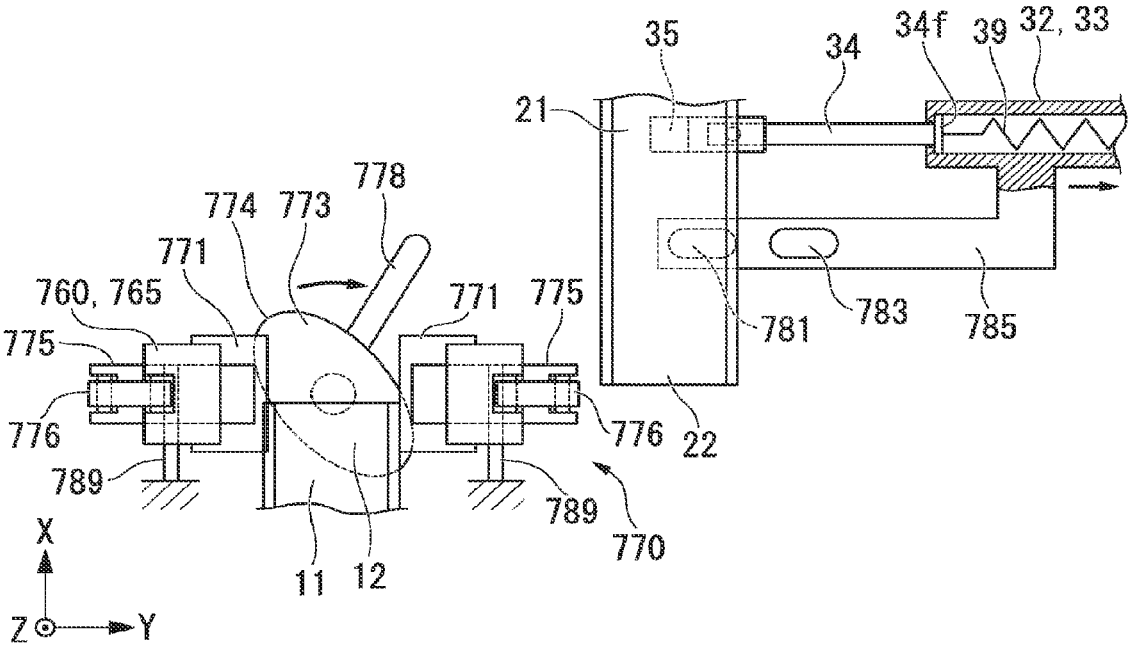
Figure 21B:
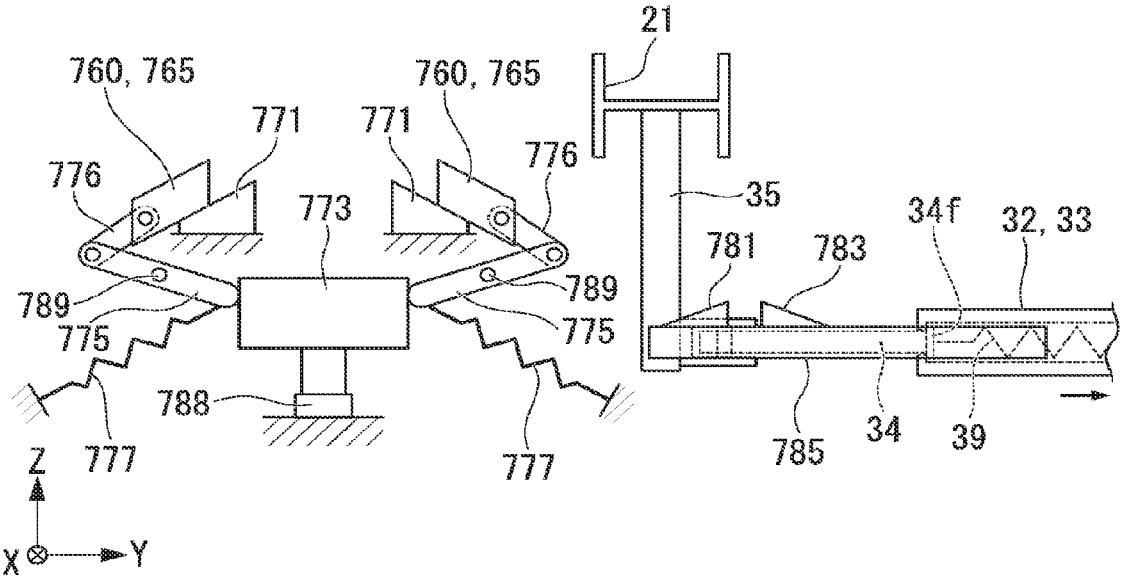

Each of FIGS. 21A and 21B is a view which shows an unlocked state of the locking mechanism of the Fifth Embodiment according to the present invention.

Figure 22:
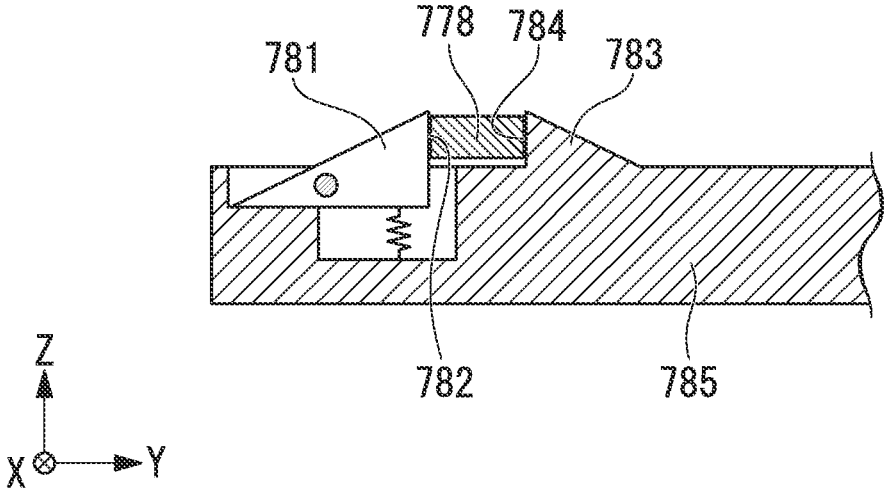

FIG. 22 is a cross-sectional view taken along line B to B in FIG. 20.

BEST MODE FOR CARRYING OUT THE INVENTION

Hereinafter, a detailed description will be given of an embodiment of the center guide-type track-based transportation system according to the present invention by referring to the drawings.

The center guide-type track-based transportation system of the present embodiment is provided with center guide-type traveling equipment having a center guide rail at the center of a traveling lane and a track-based vehicle which travels on the traveling lane.

Figure 1:
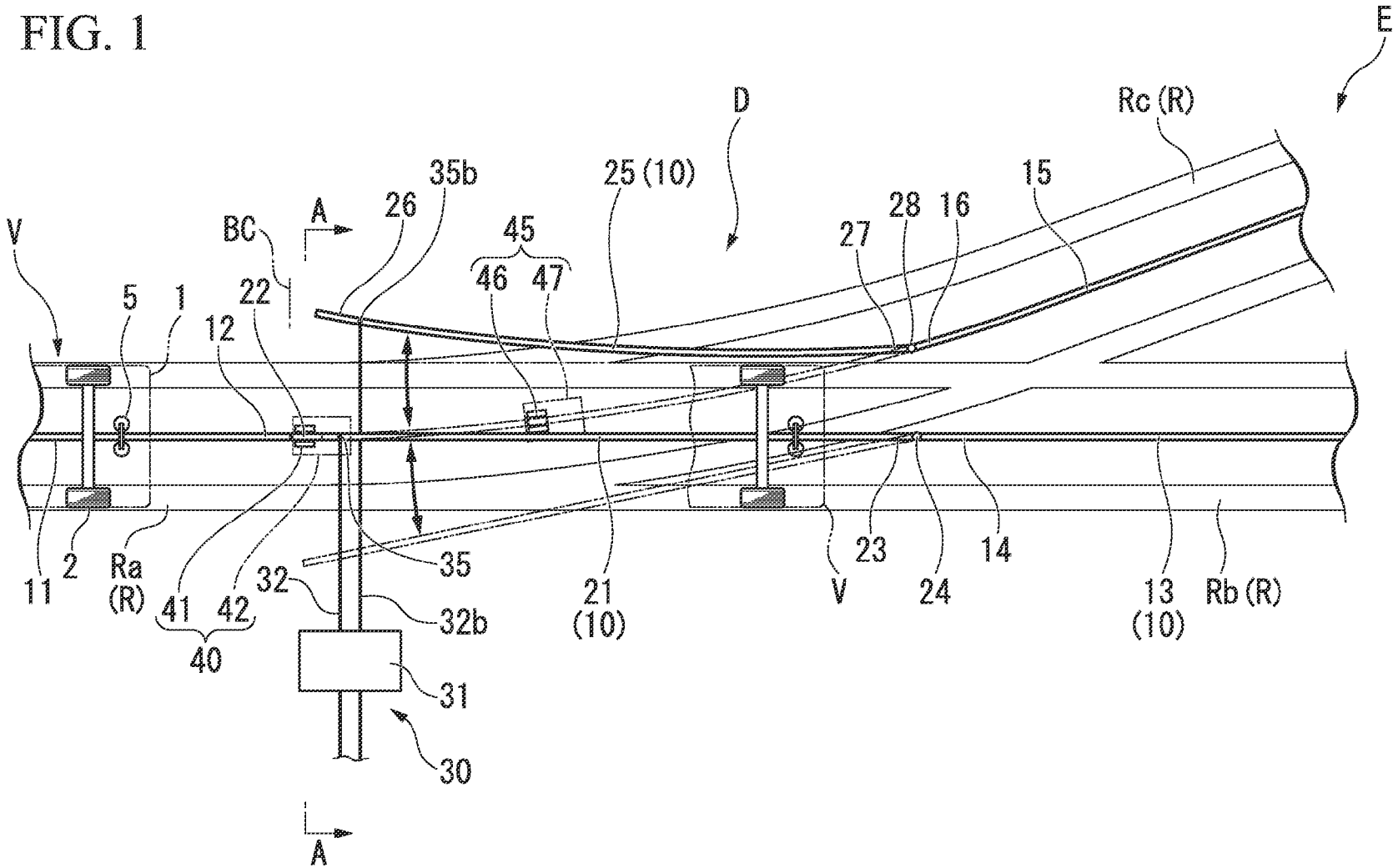
FIG. 1 is a plan view which shows a track-based transportation system (on straight movement) of one embodiment according to the present invention.
Figure 3:
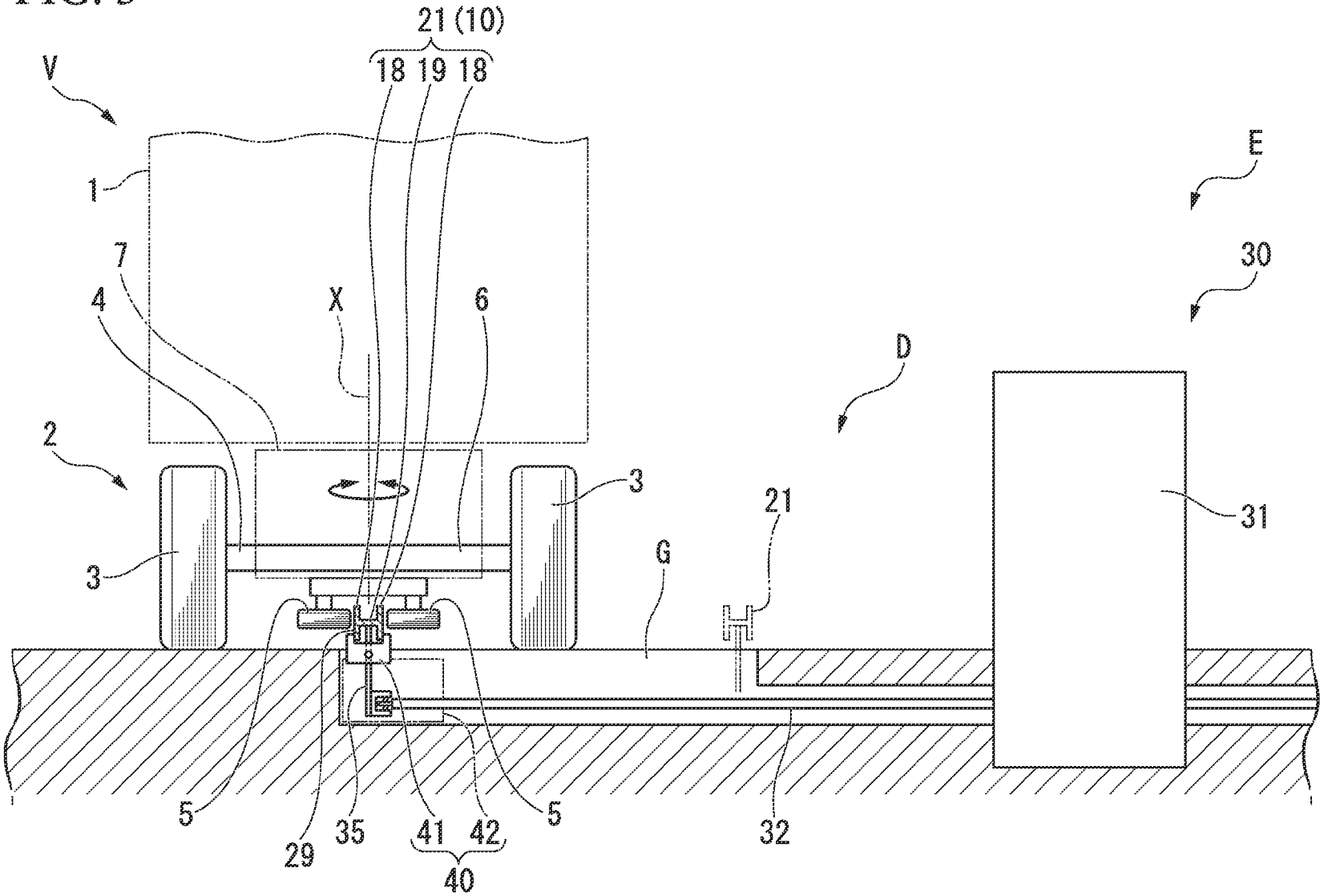
FIG. 3 is a cross-sectional view taken along line A to A in FIG. 1.

As shown in FIG. 1 and FIG. 3, a track-based vehicle V is provided with a vehicle body 1 and traveling devices 2 installed individually at the front and the rear below the vehicle body 1.

The traveling device 2 is provided with a pair of running wheels 3 aligned in a vehicle width direction, an axle 4 connecting the pair of running wheels 3 to each other, a pair of guide wheels 5 aligned in the vehicle width direction, a guide frame 6 supporting each of the pair of guide wheels 5 so as to rotate, and a steering link mechanism 7. The steering link mechanism 7 supports the guide frame 6 so as to revolve around a pivot X perpendicular to a floor surface of the vehicle body 1 at the center of the vehicle body 1 in the vehicle width direction and also steers the pair of running wheels 3 in association with revolution of the guide frame 6 around the pivot X.

The running wheel 3 is a tire, the outer circumferential part of which is made with rubber and the inside of which is filled with a gas. The guide wheel 5 is a wheel, the outer circumferential part of which is formed with an elastic member, for example, urethane rubber.

As shown in FIG. 1 and FIG. 3, the traveling equipment E is provided with a traveling lane R, a center guide rail 10 disposed at the center of the traveling lane R, and a branching device D.

The traveling lane R includes main line traveling lanes Ra, Rb and a branch line traveling lane Rc which branches from the main line traveling lanes Ra, Rb. In addition, hereinafter, on the basis of a branch starting position BC at which the branch line traveling lane Rc starts to branch from the main line traveling lanes Ra, Rb, the main line traveling lane Ra which is closer to the branch starting position BC in a traveling direction is given as a near-side main line traveling lane Ra, and the main line traveling lane Rb which is forward with respect to the branch starting position BC in the traveling direction is given as a forward-side main line traveling lane Rb. On the basis of the main line traveling lane Ra, Rb, the side on which the branch line traveling lane Rc extends in a width direction of the traveling lane is given as an inner side and the side opposite to the inner side is given as an outer side.

A near-side main line rail (fixed rail) 11 which is a center guide rail 10 is fixed at the center of the near-side main line traveling lane Ra in the traveling lane width direction. A forward-side main line rail (fixed rail) 13 which is a center guide rail 10 disposed in a direction along the forward-side main line traveling lane Rb from the near-side main line rail 11, with an interval kept, is fixed at the center of the forward-side main line traveling lane Rb in the traveling lane width direction. In addition, a branch line rail (fixed rail) 15 which is a center guide rail 10 disposed in a direction along the branch line traveling lane Rc from the near-side main line rail 11, with an interval kept, is fixed at the center of the branch line traveling lane Rc in the traveling lane width direction.

Inside an area where the traveling lane R is present, a branching section is formed between the near-side main line rail (fixed rail) 11 and the forward-side main line rail (fixed rail) 13 and between the near-side main line rail (fixed rail) 11 and the branch line rail (fixed rail) 15.

The branching device D is a device which guides the track-based vehicle V on the near-side main line traveling lane Ra to either of the traveling lanes, that is, the forward-side main line traveling lane Rb or the branch line traveling lane Rc.

The branching device D is provided with a main line movable rail 21, a branch line movable rail 25, a switching mechanism 30, a locking mechanism 40 and a locking mechanism 45. The main line movable rail 21 is a center guide rail 10 which is continuous to the forward-side main line rail 13 and able to undergo displacement, the branch line movable rail 25 is a center guide rail 10 which is continuous to the branch line rail 15 and able to undergo displacement. The switching mechanism 30 allows the main line movable rail 21 and the branch line movable rail 25 to undergo displacement. The locking mechanism 40 restrains the main line movable rail 21, while the locking mechanism 45 restrains the branch line movable rail 25.

The main line movable rail 21 is slightly shorter in length than an interval between the near-side main line rail 11 and the forward-side main line rail 13 in a direction along the forward-side main line traveling lane Rb. In the main line movable rail 21, a first end 23 thereof is installed so as to swing around a swing shaft 24 installed at the first end 23 at a position continuous to the forward-side main line rail 13. In addition, the position continuous to the forward-side main line rail 13 is a position at which the first end 23 assumes the same position in the traveling lane width direction with a near-side end 14 of a counterpart forward-side main line rail 13 in the traveling direction and allows the guide wheel 5 to guide between them by facing the counterpart forward-side main line rail 13.

Hereinafter, in the description "a position continuous to a rail" or "continuous to a rail," as described above, "continuous" means a state in which an end assumes the same position in the traveling lane width direction with its counterpart and is able to guide the guide wheel 5 when they face each other.

The branch line movable rail 25 is slightly shorter in length than an interval between the near-side main line rail 11 and the branch line rail 15 in a direction along the branch line traveling lane Rc. The branch line movable rail 25 is installed so as to swing around a swing shaft 28 installed at the first end 27 at a position at which the first end 27 is continuous to the branch line rail 15.

The individual rails 11, 13, 15, 21, 25 which constitute the so-far described center guide rail 10 are all made with an H beam. As shown in FIG. 3, this H beam is disposed in such a manner that a pair of flanges 18 parallel to each other are brought to a perpendicular direction and a web 19 connecting the pair of flanges 18 is brought to a horizontal direction, thereby constituting the center guide rail 10. The center guide rail 10 formed with an H beam is such that each of the outer faces of the pair of flanges 18, that is, each of the mutually opposing faces forms the guide face 29. In addition, here, an H beam is used to form the center guide rail 10. However, those having at least a pair of faces which are parallel to each other and are opposed to each other may be used, and for example, an I beam and the like may be used.

The switching mechanism 30 is a mechanism in which the main line movable rail 21 is allowed to swing and allowed to move laterally into one of two positions, that is, a guide position at which the second end 22 opposite to the first end 23 of the main line movable rail 21 is continuous to the near-side main line rail 11 and a retracted position at which the second end 22 is different in position from the near-side main line rail 11 in the traveling lane width direction, and also the branch line movable rail 25 is allowed to swing and move laterally into one of two positions, that is, a guide position at which the second end 26 opposite to the first end 27 of the branch line movable rail 25 is continuous to the near-side main line rail 11 and a retracted position at which the second end 26 is different in position from the near-side main line rail 11 in the traveling lane width direction.

The switching mechanism 30 is provided with a railroad switch 31, supporting posts 35, 35*b* and connecting rods 32, 32*b*. The railroad switch 31 is a lateral driving source which allows each of the main line movable rail 21 and the branch line movable rail 25 to move laterally into one of two positions, that is, a guide position and a retracted position. The supporting post 35 is such that one end thereof is fixed to the main line movable rail 21 and the other end thereof extends downward, and the supporting post 35*b* is such that one end thereof is fixed to the branch line movable rail 25 and the other end thereof extends downward. The connecting rod 32 connects the supporting post 35 of the main line movable rail 21 with the railroad switch 31, and the connecting rod 32*b* connects the supporting post 35*b* of the branch line movable rail 25 with the railroad switch 31.

Each of the connecting rods 32 extends in the width direction of the traveling lane and is disposed in a groove hole G formed further below than a traveling lane surface.

The railroad switch 31 is provided with driving sources such as a hydraulic cylinder, an electromagnetic cylinder and an electric motor. Where the electric motor is used as a driving source, for example, a rack-and-pinion is used to convert rotational movement of the electric motor to linear movement.

In this case, the railroad switch 31 is disposed so as to be on a side further outside than the forward-side main line traveling lane Rb. It is, however, acceptable that the railroad switch 31 is disposed so as to be on a side further inside than the forward-side main line traveling lane Rb. Moreover, in this case, the railroad switch 31 is connected with the main line movable rail 21 by the connecting rod 32, while the railroad switch 31 is connected with the branch line movable rail 25 by the connecting rod 32*b*. It is, however, acceptable that the main line movable rail 21 is coupled with the branch line movable rail 25 by using a single coupling link and the coupling link is connected with the railroad switch 31 by using another link.

Figure 4:
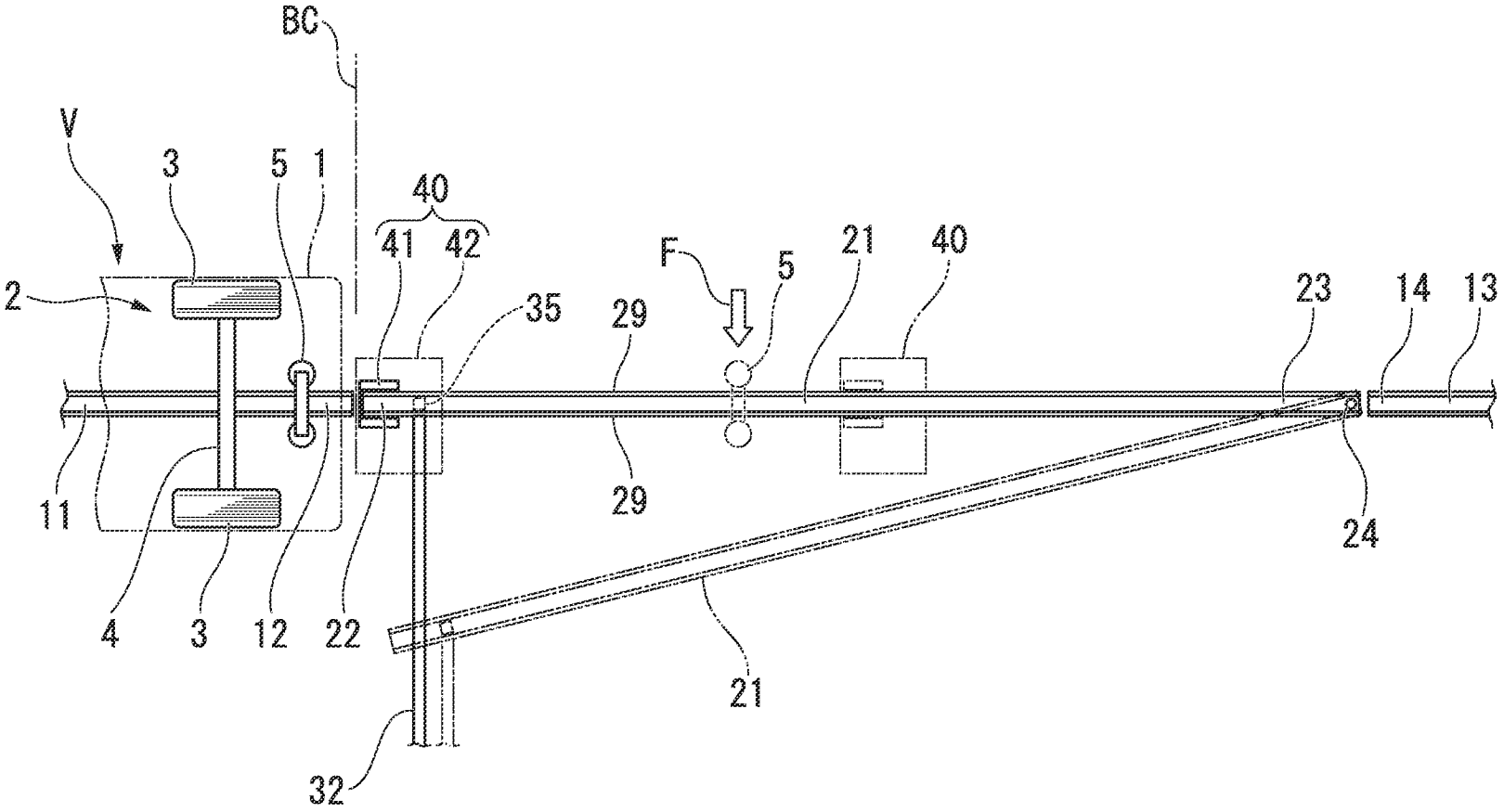
FIG. 4 is a plan view which shows a branching device of one embodiment according to the present invention.

As shown in FIG. 1 through FIG. 4 and in particular as shown in FIG. 3 and FIG. 4, the locking mechanism 40 for restraining the main line movable rail 21 is provided with an engagement member 41 and a locking action mechanism 42. The engagement member 41 is engaged with a part of the second end 22 of the main line movable rail 21 at the guide position, thereby restraining displacement of the part of the second end 22 in the width direction of the traveling lane. The locking action mechanism 42 activates the engagement member 41 so as to change between a locked state in which engagement is made with the main line movable rail 21 at the guide position and an unlocked state in which engagement with the main line movable rail 21 is released.

Figure 2:
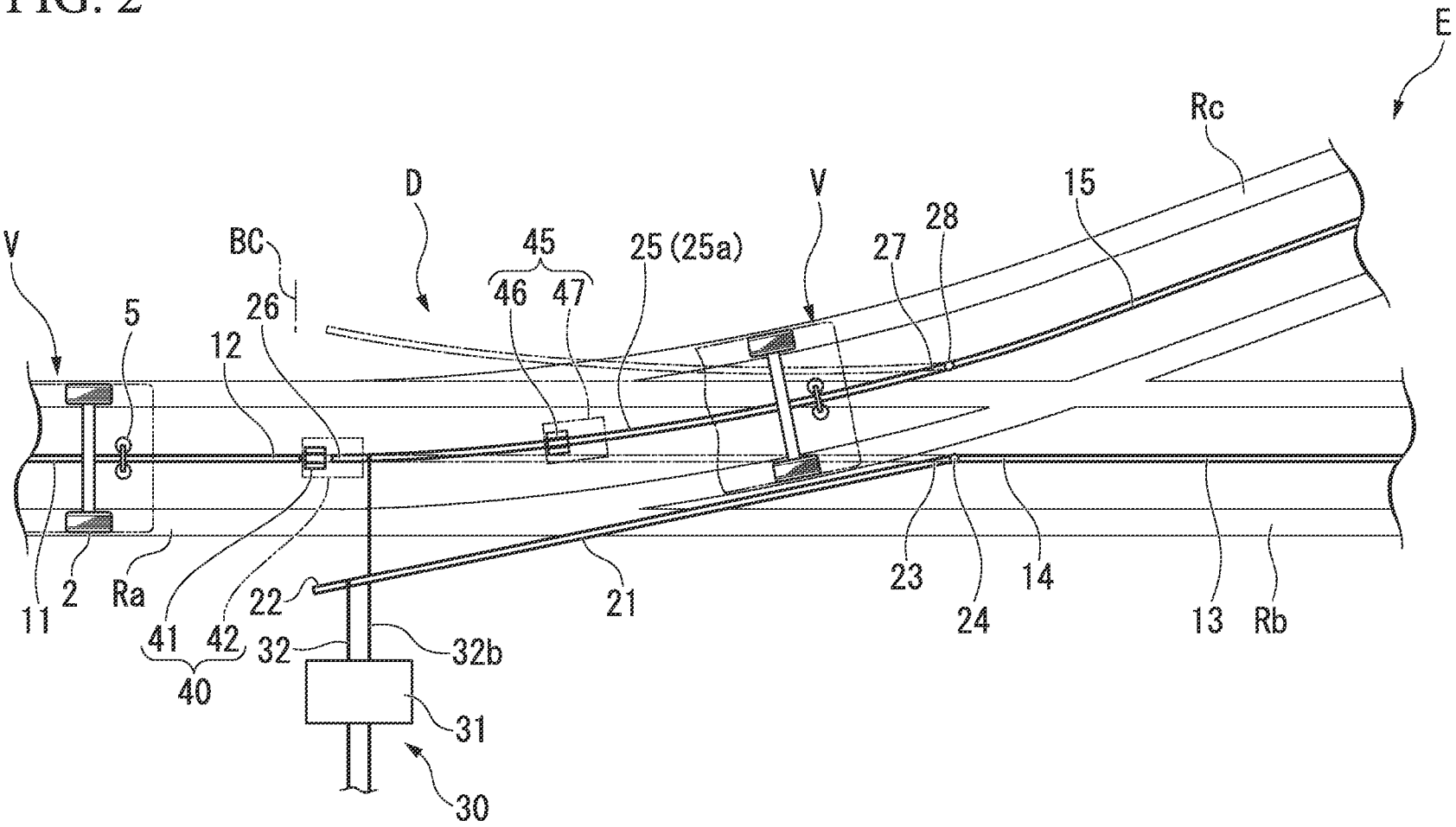
FIG. 2 is a plan view which shows the track-based transportation system (on branching) of one embodiment according to the present invention.

As shown in FIG. 1 and FIG. 2, the locking mechanism 45 for restraining the branch line movable rail 25 is provided with an engagement member 46 and a locking action mechanism 47. The engagement member 46 is engaged with a part of the second end 26 of the branch line movable rail 25 at the guide position, thereby restraining displacement of the part of the second end 26 in the traveling lane width direction. The locking action mechanism 47 activates the engagement member 46 so as to change between a locked state in which engagement is made with the branch line movable rail 25 at the guide position and an unlocked state in which engagement with the branch line movable rail 25 is released.

The locking mechanism 40 for restraining the main line movable rail 21 is similar in structure to the locking mechanism 45 for restraining the branch line movable rail 25 except that they are different in an object to be restrained.

Each of the locking action mechanisms 42, 47 is disposed in the groove hole G in which the connecting rod 32 of the switching mechanism 30 is disposed.

In addition, in FIG. 1 and FIG. 2, the locking mechanism 40 for restraining the main line movable rail 21 and the locking mechanism 45 for restraining the branch line movable rail 25 are drawn so as to be positioned away to some extent in a direction along the traveling lane. This is, however, due to convenience in drawing the figures. The locking mechanisms 40, 50 are actually in close proximity to each other. In FIG. 1 and FIG. 2, the locking mechanism 45 for restraining the branch line movable rail 25 is disposed further forward in the traveling direction than the locking mechanism 40 for restraining the main line movable rail 21. However, the locking mechanism 45 may be disposed on the near side in the traveling direction.

Next, a description will be given of motion of the branching device of the present embodiment and behavior of the track-based vehicle V in association with the motion.

First, a description will be given of motion of the branching device D when the track-based vehicle V traveling on the near-side main line traveling lane Ra is guided to the forward-side main line traveling lane Rb and behavior of the track-based vehicle V in association with the motion.

Where the track-based vehicle V traveling on the near-side main line traveling lane Ra is guided to the forward-side main line traveling lane Rb, the switching mechanism 30 of the branching device D allows the main line movable rail 21 to assume the guide position, as shown in FIG. 1, FIG. 3 and FIG. 4, and also allows the branch line movable rail 25 to assume the retracted position. In this case, where the branch line movable rail 25 is present at the guide position and the engagement member 46 of the locking mechanism 45 for the branch line movable rail 25 is engaged with the branch line movable rail 25, the locking action mechanism 47 of the locking mechanism 45 is driven in association with actuation of the switching mechanism 3. And, the engagement member 46 is activated so as to change to an unlocked state, thereby releasing engagement with the branch line movable rail 25.

In the main line movable rail 21 at the guide position, the first end 23 is continuous to the forward-side main line rail 13 and the second end 22 is also continuous to a traveling-direction forward end 12 of the near-side main line rail 11. In the branch line movable rail 25 at the retracted position, the second end 26 is different in position from the traveling-direction forward end 12 of the near-side main line rail 11 in the width direction of the traveling lane, and the branch line movable rail 25 is positioned on the inner side so as not to be in contact with the track-based vehicle V when traveling on the forward-side main line traveling lane Rb.

The switching mechanism 30 is driven, by which the main line movable rail 21 is carried to the guide position. At this time, the engagement member 41 of the locking mechanism 40 is engaged with a part of the second end 22 of the main line movable rail 21, thereby restraining displacement of the part of the second end 22 in the traveling lane width direction.

When the track-based vehicle V traveling on the near-side main line traveling lane Ra is guided by the near-side main line rail 11 to enter into the branching section, the main line movable rail 21 at the guide position is to be positioned between a pair of guide wheels 5 of the track-based vehicle V. And, the track-based vehicle V is guided by the main line movable rail 21 to travel on the forward-side main line traveling lane Rb. Then, the pair of guide wheels 5 of the track-based vehicle V move from the main line movable rail 21 to the forward-side main line rail 13 continuous to the main line movable rail 21. At this time, the track-based vehicle V is guided by the forward-side main line rail 13 and travels on a traveling lane along a direction at which the forward-side main line rail 13 extends, that is, on the forward-side main line traveling lane Rb.

Next, a description will be given of motion of the branching device D when the track-based vehicle V traveling on the near-side main line traveling lane Ra is guided to the branch line traveling lane Rc and behavior of the track-based vehicle V in association with the motion.

Where the track-based vehicle V traveling on the near-side main line traveling lane Ra is guided to the branch line traveling lane Rc, as shown in FIG. 2, the switching mechanism 30 of the branching device D allows the main line movable rail 21 to assume the retracted position and also allows the branch line movable rail 25 to assume the guide position. In this case, where the main line movable rail 21 is present at the guide position and the engagement member 41 of the locking mechanism 40 for the main line movable rail 21 is engaged with the main line movable rail 21, the locking action mechanism 42 of the locking mechanism 40 is driven in association with actuation of the switching mechanism 30, by which the engagement member 41 is activated so as to change to an unlocked state. Thereby, engagement with the main line movable rail 21 is released.

The main line movable rail 21 at the retracted position is such that the second end 22 thereof is different in position from the traveling-direction forward end 12 of the near-side main line rail 11 in the traveling lane width direction and assumes an outer side position so as not to be in contact with the track-based vehicle V when traveling on the branch line traveling lane Rc. The branch line movable rail 25 at the guide position is such that the first end 27 thereof is continuous to the branch line rail 15 and the second end 26 thereof is also continuous to the traveling-direction forward end 12 of the near-side main line rail 11.

When the switching mechanism 30 is driven to carry the branch line movable rail 25 to the guide position, the engagement member 46 of the locking mechanism 45 is engaged with a part of the second end 26 of the branch line movable rail 25, thereby restraining displacement of the second end 26 in the traveling lane width direction.

When the track-based vehicle V traveling on the near-side main line traveling lane Ra is guided to the near-side main line rail 11 to enter into the branching section, the branch line movable rail 25 at the guide position is positioned between the pair of guide wheels 5 of the track-based vehicle V and the track-based vehicle V is guided by the branch line movable rail 25 to travel on the branch line traveling lane Rc. Then, when the pair of guide wheels 5 of the track-based vehicle V move from the branch line movable rail 25 to the branch line rail 15 continuous to the branch line movable rail 25, the track-based vehicle V is guided by the branch line rail 15 and travels on a traveling lane along a direction at which the branch line rail 15 extends, that is, on the branch line traveling lane Rc.

As described so far, in the present embodiment, the traveling lane at the branching section is not allowed to move in an integrated manner with the movable rails 21, 25 but only the movable rails 21, 25 are moved to guide the track-based vehicle V to an intended traveling lane. It is therefore possible to downsize the switching mechanism 30 and also reduce the energy consumed by the switching mechanism 30. Accordingly, the present embodiment is able to suppress initial costs and running costs of the branching device D.

In addition, when the track-based vehicle V traveling on the near-side main line traveling lane Ra is guided to the near-side main line rail 11 to enter into the branching section, as described previously, the main line movable rail 21 at the guide position or the branch line movable rail 25 is to be positioned between the pair of guide wheels 5 of the track-based vehicle V. At this time, either of the pair of guide wheels 5 is in contact with the main line movable rail 21 at the guide position or the branch line movable rail 25 at the guide position, thereby receiving a force in the traveling lane width direction.

When the main line movable rail 21 is taken as an example, as shown in FIG. 4, either of the pair of guide wheels 5 is in contact with the main line movable rail 21, by which the main line movable rail 21 receives a force F in the traveling lane width direction.

It is assumed that unless a part of the second end 22 of the main line movable rail 21 is restrained so as not to undergo displacement by the locking mechanism 40, the main line movable rail 21 is such that the second end 22 thereof is supported by a connecting rod 32 of the switching mechanism 30 and the first end 23 thereof is supported by the swing shaft 24 with respect to the force F in the traveling lane width direction.

The connecting rod 32 of the switching mechanism 30 is to move in the traveling lane width direction in association with actuation of the railroad switch 31, thereby allowing the main line movable rail 21 to move laterally into one of two positions, that is, the guide position and the retracted position. Therefore, the connecting rod 32 is not designed so as to receive the force F in the traveling lane width direction that the main line movable rail 21 has received from the guide wheels 5 and lower in rigidity in the traveling lane width direction. That is, the second end 22 of the main line movable rail 21 is lower in supporting rigidity and the main line movable rail 21 is actually in a cantilever support state which is supported only by the swing shaft 24 at the first end 23.

As a result, when the main line movable rail 21 receives the force F in the traveling lane width direction from the guide wheels 5, the main line movable rail 21 deflects to a great extent in the traveling lane width direction, by which behavior of the track-based vehicle V guided by the guide wheels 5 becomes unstable, resulting in deterioration of ride quality of the track-based vehicle V. The main line movable rail 21 deflects to a greater extent and the swing shafts 24, 28 also receive great loads, by which these components are repaired or exchanged more frequently.

Thus, in the present embodiment, a part of the second end 22 of the main line movable rail 21 at the guide position is restrained by the locking mechanism 40 so as not to undergo displacement. As a result, the main line movable rail 21 is in a state of being supported at both ends by the engagement member 41 of the locking mechanism 40 and also by the swing shaft 24 with respect to the force F in the traveling lane width direction. Therefore, in the present embodiment, even if the main line movable rail 21 receives the force F in the traveling lane width direction from the guide wheels 5, the main line movable rail 21 deflects to a small extent in the traveling lane width direction and the track-based vehicle V guided by the guide wheels 5 becomes stable in behavior, thus making it possible to improve the ride quality of the track-based vehicle V. The main line movable rail 21 deflects to a smaller extent to reduce loads applied to the swing shaft 24, by which these components are improved in maintenance.

As described so far, in the present embodiment, the initial costs and running costs of the branching device D are not only suppressed but also movable rails 21, 25 can be supported stably. It is thereby possible to improve the ride quality of the track-based vehicle V and maintenance of the movable rails 21, 25 and the like.

In the above description, the locking mechanism 40 is installed only at a part of the second end 22 of the main line movable rail 21. However, as indicated with an imaginary outline (two-dot chain line) in FIG. 4, the locking mechanism 40 may be additionally installed further forward in the traveling direction than the locking mechanism 40. Moreover, in a similar manner, the locking mechanism 45 may be installed not only at a part of the second end 26 of the branch line movable rail 25 but also at a traveling-direction forward part of the branch line movable rail 25. As described above, the plurality of locking mechanisms 40, 45 are installed on the movable rails 21, 25, by which it is possible to further decrease deflection of the movable rails 21, 25 and also reduce loads applied to the swing shafts 24, 28.

Next, a detailed description will be hereinafter given of an embodiment of the locking mechanisms 40, 45. As described previously, the locking mechanism 40 for restraining the main line movable rail 21 is similar in structure to the locking mechanism 45 for restraining the branch line movable rail 25 except that they are different in a target to be restrained. Thus, in the following description, when an expression of the locking mechanisms 40, 45 is used unless otherwise specified, this expression indicates the locking mechanism 40 for restraining the main line movable rail 21, and a detailed description will be given of the locking mechanism 40 for restraining the main line movable rail 21. Hereinafter, for convenience of description, a direction at which the main line movable rail 21 at the guide position extends is given as an X direction, and a traveling-direction forward side of the main line movable rail 21 in the X direction is given as a (+) X side. A direction along the traveling lane width direction is given as a Y direction, and an outer side from the traveling lane in the Y direction is given as a (+) Y side. In addition, a direction perpendicular to a traveling lane surface is given as a Z direction and a side on which the track-based vehicle V can be present on the basis of the traveling lane surface in the Z direction, that is, an upper side, is given as a (+) Z side. However, the (+) Z side may be expressed as an upper side and a (−) Z side may be expressed as a lower side in some cases.

(Locking Mechanism of First Embodiment)

Hereinafter, a detailed description will be given of a locking mechanism as a First Embodiment by referring to FIG. 5A to FIG. 9B.

As shown in FIGS. 5A to 5C, a locking mechanism 100 of the present embodiment is a mechanism which allows an engagement member 110 to move rotationally around a rotational movement shaft 121 extending in the X direction, thereby activating the engagement member 110 so as to change between a locked state and an unlocked state. In addition, FIG. 5A shows the unlocked state, FIG. 5B shows a state in transition from the unlocked state to the locked state and FIG. 5C shows the locked state.

As shown in FIGS. 6A to 6C, the engagement member 110 is provided with a main body 111 formed in a rectangular solid shape and a pair of projections 115 fixed so as to face each other at an upper face of the main body 111. An interval between the pair of projections 115 is made slightly larger than an interval between a pair of guide faces 29 of a main line movable rail 21 so as to retain the main line movable rail 21. Each of Fig. FIG. 6A to Fig. FIG. 9A is a plan view of the locking mechanism 100, in a similar manner, each of FIG. 6B to FIG. 9B is a front view of the locking mechanism 100 and each FIG. 6C to FIG. 9C is a side view of the locking mechanism 100.

A locking action mechanism 120 of the locking mechanism 100 is provided with a rotational movement shaft 121, a regulation member 130 and an interlocking mechanism 140. The rotational movement shaft 121 extends in the X direction to support the engagement member 110 so as to move rotationally. The regulation member 130 regulates rotational movement of the engagement member 110. The interlocking mechanism 140 functions as a conversion unit which allows the regulation member 130 to move in association with movement of a connecting rod 32.

The engagement member 110 is supported by the rotational movement shaft 121 to move rotationally in such a manner that it can be activated so as to change between a locked state (FIGS. 6A to 6C) in which a pair of projections 115 are aligned in the Y direction, the projections 115 of the engagement member 110 are opposed individually to a pair of guide faces 29 of the main line movable rail 21 at the guide position and the main line movable rail 21 is retained between the pair of projections 115 and an unlocked state (FIGS. 9A and 9B) in which, of the pair of projections 115, the projection 115 on the (+) Y side is positioned further below than the projection 115 on the (−) Y side and the main line movable rail 21 is able to make a relative movement with respect to the engagement member 110 in the Y direction. The rotational movement shaft 121 is fixed on a wall face inside a groove hole G in which the locking action mechanism 120 is disposed via a bracket or the like.

The engagement member 110 is urged by an engagement member spring (elastic body) 122 in a direction at which, of the pair of projections 115, the projection 115 on the (+) Y side is positioned further below than the projection 115 on the (−) Y side around the rotational movement shaft 121. The engagement member spring 122 is disposed on the (−) Y side from the rotational movement shaft 121 and further below than the engagement member 110. An end of the engagement member spring 122 is fixed on the wall face inside the groove hole G in which the locking action mechanism 120 is disposed via a bracket or the like.

The regulation member 130 is disposed further on the (+) Y side than the rotational movement shaft 121. The regulation member 130 is provided with a flat first face 131 which is in contact with a lower face of the main body 111 of the engagement member 110 in the locked state to keep the engagement member 110 in the locked state against an urging force of the engagement member spring 122, a second face 132 and a third face 135 on the opposite side of the first face 131, a fourth face 138 perpendicular to the first face 131 and facing the (−) Y side, and a guide long hole 139 going through in the X direction.

The second face 132 is provided with a circular arc plane 134 which is continuous to the first face 131 at an end of the regulation member 130 on the (−) Y side and a flat plane 133 which is formed from an end of the circular arc plane 134 on the (+) Y side and is parallel with the first face 131. The fourth face 138 is formed from an end of the flat plane 133 of the second face 132 on the (+) Y side so as to be perpendicular to the flat plane 133. The third face 135 is provided with a circular arc plane 137 which is formed from a position which is a lower end of the fourth face 138 and a flat plane 136 which is formed from the end of the circular arc plane 137 on the (+) Y side and parallel with the first face 131.

The guide long hole 139 is provided on an inner face thereof with a pair of guide faces 139*g* which face each other and are parallel with the flat planes 133, 136 of the first face 131 and the second face 132.

The interlocking mechanism 140 is provided with a regulation member spring (elastic body) 141, a projection body 142, and guide rollers 145 to 148. The regulation member spring 141 urges the regulation member 130 to the (−) Y side. The projection body 142 pushes the regulation member 130 to the side of the retracted position, that is, to the (+) Y side, during which the switching mechanism 30 allows the main line movable rail 21 at the guide position to move to the retracted position. The guide rollers 145 to 148 guide the movement of the regulation member 130.

An end of the regulation member spring 141 is fixed to the wall face inside the groove hole G in which the locking action mechanism 120 is disposed via a bracket or the like. The guide rollers 145 to 148 are fixed to the wall face inside the groove hole G so as to extend and also rotate in the X direction via a bracket or the like.

The guide rollers 145 to 148 include a first guide roller 145 which is in contact with the first face 131 of the regulation member 130 in transition from a locked state to an unlocked state, a second guide roller 146 which is in contact with the second face 132 of the regulation member 130, a third guide roller 147 which is in contact with the third face 135 of the regulation member 130, and a fourth guide roller 148 which is inserted into the guide long hole 139 of the regulation member 130 and in contact with the pair of guide faces 139*g* of the guide long hole 139.

The projection body 142 is attached to a connecting rod 32 of the switching mechanism 30. The connecting rod 32 is provided with a rod main body 33 and a connecting bar 34. The rod main body 33 is connected to the railroad switch 31 and the connecting bar 34 is attached to an end of the rod main body 33 on the (−) Y side so as to make a relative movement with the rod main body 33 in a longitudinal direction thereof. A flange 34*f* is formed on the (+) Y side of the connecting bar 34 and the flange 34*f* restricts a relative movement of the connecting bar 34 with the rod main body 33. An end of the connecting bar 34 on the (−) Y side is connected by using a pin with a supporting post 35 which is fixed to the main line movable rail 21. The projection body 142 is attached to the rod main body 33 so as to rotate around a shaft extending in the Y direction. The projection body 142 is provided with a pressing face 143 which can be in contact with the fourth face 138 of the regulation member 130 and an inclined face 144 which inclines to the pressing face 143. In the projection body 142, a part on the side of the pressing face 143 with respect to a rotating shaft is urged to the (+) Z side by a projection body spring (elastic body).

Next, a description will be given of motion of the locking mechanism 100 which has been described so far.

First, a description will be given of a locked state of the engagement member 110 and a state of the locking action mechanism 120 at this time.

As shown in FIGS. 6A to 6C, the engagement member 110 in the locked state is such that the projections 115 of the engagement member 110 are opposed individually to the pair of guide faces 29 of the main line movable rail 21 at the guide position and the main line movable rail 21 is retained between the pair of projections 115. That is, the engagement member 110 in the locked state is engaged with the main line movable rail 21 at the guide position.

The regulation member 130 is in contact with a lower face of the main body 111 of the engagement member 110 in a state in which the first face 131 thereof is perpendicular in the Z direction to regulate the rotational movement of the engagement member 110 caused by an urging force of the engagement member spring 122.

Thereby, when the regulation member 130 assumes this position, the engagement member 110 is retained in the locked state. In the regulation member 130, the first face 131 is in contact with the first guide roller 145, the flat plane 133 of the second face 132 is in contact with the second guide roller 146, the flat plane 136 of the third face 135 is in contact with the third guide roller 147, the guide face 139*g* of the guide long hole 139 is in contact with the fourth guide roller 148. The first face 131 of the regulation member 130, the flat plane 133 of the second face 132, the flat plane 136 of the third face 135 and the guide face 139*g* of the guide long hole 139 are kept perpendicular in the Z direction because the first face 131 is perpendicular in the Z direction.

The pressing face 143 of the projection body 142 which is attached to the connecting rod 32 is in contact with the fourth face 138 of the regulation member 130 to regulate movement to the (−) Y side of the regulation member 130 which is urged to the (−) Y side by the regulation member spring 14.

The connecting bar 34 of the connecting rod 32 is kept in a state by the flange 34*f* such that it is not able to make a relative movement with the rod main body 33 to the (+) Y side but able to make a relative movement to the (−) Y side. That is, even if the rod main body 33 moves to the (+) Y side, the connecting bar 34 is able to remain there.

Here, a brief description will be given of a positional relationship between these guide rollers 145 to 148.

It is assumed that a maximum relative movement distance between the connecting bar 34 and the rod main body 33 is given as Y1. It is also assumed that half a dimension in the Y direction between a point at which the engagement member 110 in the locked state receives an urging force from the engagement member spring 122 and an action point at which the engagement member 110 allows an urging force from the engagement member spring 122 to act on the regulation member 130 is given as Y2.

The second guide roller 146 is installed at a position which is a distance of Y2 to the (+) Y side from the action point at which the engagement member 110 is in the locked state. Each of the first guide roller 145 and the fourth guide roller 148 is installed at a position which is a distance of Y2 to the (+) Y side from the second guide roller 146. In addition, a distance from a position at which the third guide roller 147 is in contact with the flat plane 133 of the third face 135 of the regulation member 130 to the circular arc plane 137 of the third face 135 is made slightly longer than Y1.

It is assumed that in order to allow the main line movable rail 21 to move to the retracted position from the above-described state, the railroad switch 31 of the switching mechanism 30 is driven, by which the rod main body 33 starts to move to the (+) Y side. At this time, the connecting bar 34 is able to remain there even if the rod main body 33 moves to the (+) Y side. Therefore, the main line movable rail 21 at the guide position which is connected via the supporting post 35 to the connecting bar 34 will not move.

On the other hand, as shown in FIGS. 7A and 7B, when the rod main body 33 starts to move to the (+) Y side, the projection body 142 attached to the rod main body 33 starts to move to the (+) Y side in association with movement of the rod main body 33. Therefore, the regulation member 130 in which the fourth face 138 thereof is in contact with the pressing face 143 of the projection body 142 is also pressed by the projection body 142 and starts to move to the (+) Y side. As a result, the engagement member 110 is no longer in contact with the first face 131 of the regulation member 130. At this time, the second guide roller 146 is positioned at a border between the flat plane 133 of the second face 132 of the regulation member 130 and the circular arc plane 134, and the third guide roller 147 is positioned at a border between the flat plane 136 of the third face 135 of the regulation member 130 and the circular arc plane 137. The connecting bar 34 of the connecting rod 32 is kept in a state by the flange 34*f* such that it is not able to make a relative movement with the rod main body 33 to the (−) Y side but able to make a relative movement to the (+) Y side. That is, when the rod main body 33 moves further to the (+) Y side, the connecting bar 34 is in a state in which it is able to move to the (+) Y side in association with this movement.

When the engagement member 110 is no longer in contact with the first face 131 of the regulation member 130, as shown in FIGS. 8A and 8B, the engagement member 110 is not regulated for rotational movement by an urging force of the engagement member spring 122. Thereby, the projection 115 of the engagement member 110 on the (+) Y side is positioned further below than the projection 115 on the (−) Y side to develop an unlocked state in which the main line movable rail 21 is able to make a relative movement with the engagement member 110 in the Y direction.

When the rod main body 33 moves further to the (+) Y side from the above state, as shown in FIG. 8A to FIG. 9B, the connecting bar 34 moves to the (+) Y side in association with this movement. Therefore, the main line movable rail 21 which is connected to the connecting bar 34 via the supporting post 35 starts to move to the (+) Y side.

The regulation member 130 is pressed by the projection body 142 attached to the rod main body 33 and moves to the (+) Y side. At the same time, the second guide roller 146 is in contact with the circular arc plane 134 of the second face 132 and the third guide roller 147 is in contact with the circular arc plane 137 of the third face 135. Therefore, the first face 131 of the regulation member 130 starts to incline by being guided by the second guide roller 146 and the third guide roller 147. That is, an end of the regulation member 130 on the (−) Y side descends, while an end thereof on the (+) Y side ascends. As a result, the fourth face 138 of the regulation member 130 is no longer in contact with the pressing face 143 of the projection body 142 attached to the rod main body 33 and the regulation member 130 will not move to the (+) Y side together with the rod main body 33. Then, when the rod main body 33 moves further to the (+) Y side and the main line movable rail 21 is carried to the retracted position, the railroad switch 31 will halt.

The regulation member 130 moves to the (−) Y side by an urging force of the regulation member spring 141 when the fourth face 138 thereof is no longer in contact with the pressing face 143 of the projection body 142 attached to the rod main body 33. As shown with an imaginary outline (two-dot chain line) in FIGS. 9A and 9B, the regulation member 130 returns to a position which is substantially the same as that shown in FIGS. 6A to 6C.

Next, a description will be given of motion of the locking mechanism 100 during which the main line movable rail 21 at the retracted position moves to the guide position.

In order to allow the main line movable rail 21 to move to the guide position from the retracted position, the railroad switch 31 of the switching mechanism 30 is driven, by which the main line movable rail 21 moves to the (−) Y side together with the connecting rod 32. When the guide face 29 of the main line movable rail 21 on the (−) Y side is in contact with the projection 115 of the engagement member 110 on the (−) Y side, the engagement member 110 starts to move rotationally in a direction at which the projections 115 on the (+) Y side ascend against an urging force of the engagement member spring 122. Then, at a time point when the main line movable rail 21 is carried to the guide position, the engagement member 110 develops into the previously described locked state in which the projections 115 of the engagement member 110 are opposed individually to the pair of guide faces 29 of the main line movable rail 21.

In the above-described movement of the connecting rod 32, when the inclined face 144 of the projection body 142 attached to the rod main body 33 is in contact with the circular arc plane 137 of the third face 135 of the regulation member 130, the pressing face 143 of the projection body 142 descends below. Then, when the inclined face 144 of the projection body 142 is no longer in contact with the circular arc plane 137 of the third face 135 of the regulation member 130, the pressing face 143 of the projection body 142 is pushed upward by a projection body spring, by which the pressing face 143 of the projection body 142 is brought into contact with the fourth face 138 of the regulation member 130. As a result, the locking mechanism 100 returns to a state that has been described by referring to FIGS. 6A to 6C.

(Locking Mechanism of Second Embodiment)

Next, a detailed description will be given of a locking mechanism of a Second Embodiment by referring to FIG. 10 to FIG. 12C.

As shown in FIGS. 11A to 11C, a locking mechanism 250 of the present embodiment is a mechanism in which a pair of projections 265 of an engagement member 260 are allowed to move rotationally around a rotational movement shaft 263 extending in the X direction, thereby activating the engagement member 260 so as to change between a locked state and an unlocked state. In addition, each of FIG. 11A and FIG. 12A is a plan view of the locking mechanism 250, in a similar manner, each of FIG. 11B and FIG. 12B is a front view of the locking mechanism 250 and each of FIG. 11C and FIG. 12C is a side view of the locking mechanism 250.

The pair of projections 265 of the engagement member 260 are both installed so as to move rotationally around the rotational movement shaft 263 extending in the X direction with respect to a main body 261 of the engagement member 260. Each of the projections 265 is provided with a first piece portion 266 which is rectangular plate-like shaped and a second piece portion 267 installed at an end of the first piece portion 266 at a right angle with respect to the first piece portion 266. The rotational movement shaft 263 is positioned at a part where the first piece portion 266 of each projection 265 is joined to the second piece portion 267 thereof. An interval between the first piece portions 266 of individual projections 265 in a state in which the first piece portions 266 of individual projections 265 are opposed to each other and also parallel to each other is made slightly wider than an interval between the pair of guide faces 29 of the main line movable rail 21 so as to retain the main line movable rail 21 at this time. Each of the projections 265 is urged by a coil spring (elastic body) 264 in a direction at which an interval between ends of the first piece portions 266 of individual projections 265 is increased.

The locking action mechanism 270 of the locking mechanism 250 is provided with the rotational movement shaft 263 and the coil spring 264 installed on the projection 265, an actuator 271 for raising up and down the engagement member 260 and a driving switch 275 of the actuator 271. The actuator 271 is a driving source for activating the engagement member 260 so as to change and provided with a driving rod 272 extending in a vertical direction and a casing 273 for supporting the driving rod 272 so as to move vertically. The casing 273 of the actuator 271 is fixed on a bottom face inside a groove hole G in which the locking action mechanism 270 is disposed. A main body 261 of the engagement member 260 is attached to an upper end of the driving rod 272. That is, the engagement member 260 is supported by the actuator 271.

In the engagement member 260 supported by the actuator 271, an in-plane position which is perpendicular to the Z direction is a position at which both a second end 22 of the main line movable rail 21 at the guide position and an end 12 of a near-side main line rail (fixed rail) 11 continuous to the second end 22 can be retained by the projections 265.

The rod main body 33 of the connecting rod 32 is provided with a contact end 37 extending downward from the rod main body 33. The driving switch 275 is disposed at a position at which the main line movable rail 21 is in contact with the contact end 37 at the guide position. The driving switch 275 is fixed on the bottom face inside the groove hole G in which the connecting rod 32 is disposed.

Next, a description will be given of motion of the locking mechanism 250 which has been described above.

First, a description will be given of a locked state of the engagement member 260 and a state of the locking action mechanism 270 at this time.

As shown in FIGS. 11A to 11C, the projections 265 of the engagement member 260 in the locked state are such that the first piece portions 266 of the projection 265 of the engagement member 260 are opposed individually to the pair of guide faces 29 of the main line movable rail 21 at the guide position and the main line movable rail 21 is retained between these first piece portions 266 of the pair of projections 265. The second piece portion 267 of the projection 265 is in contact with a lower end of the main line movable rail 21. Therefore, rotational movement of each projection 265 by an urging force of the coil spring 264 is regulated by the main line movable rail 21. That is, each projection 265 urged by the coil spring 264 is kept in a state in which an interval between an end of the first piece portion 266 of each projection 265 and another end thereof is not increased.

At this time, the first piece portions 266 of the pair of projections 265 are also opposed individually to the pair of guide faces 29 at an end of the near-side main line rail (fixed rail) 11 continuous to the main line movable rail 21. Each of the second piece portions 267 of the pair of projections 265 is also in contact with a lower end of the near-side main line rail 11 continuous to the main line movable rail 21. That is, the engagement member 260 is engaged with a second end 22 of the main line movable rail 21 at the guide position and also with an end 12 of the near-side main line rail 11 continuous to the second end 22.

The connecting bar 34 of the connecting rod 32 is in such a state that it is not able to make a relative movement with the rod main body 33 to the (+) Y side but able to make a relative movement to the (−) Y side. That is, the connecting bar 34 is in a state in which it is able to remain there, even if the rod main body 33 moves to the (+) Y side.

The driving switch 275 is in contact with the contact end 37 which is formed on the rod main body 33.

As shown in FIGS. 12A to 12C, it is assumed that the railroad switch 31 is driven for allowing the main line movable rail 21 to move to the retracted position from the above-described state and the rod main body 33 starts to move to the (+) Y side. At this time, the connecting bar 34 is able to remain there even if the rod main body 33 moves to the (+) Y side. Therefore, the main line movable rail 21 at the guide position which is connected via the supporting post 35 to the connecting bar 34 will not move. The rod main body 33 moves to the (+) Y side, by which the driving switch 275 is in a state in which it is not in contact with the contact end 37 formed on the rod main body 33.

When the driving switch 275 changes from a contact state to a non-contact state, the actuator 271 is driven, by which the driving rod 272 starts to descend. The engagement member 260 also descends in association with the descent of the driving rod 272. With the descent of the engagement member 260, the second piece portions 267 of the pair of projections 265 of the engagement member 260 are no longer in contact with a lower end of the main line movable rail 21 and a lower end of the near-side main line rail 11. Due to an urging force of the coil spring 264, each of the projections 265 is in a state in which an interval between ends of the first piece portions 266 of the projections 265 is increased. Then, even if the main line movable rail 21 moves to the Y direction, the actuator 271 will halt when the engagement member 260 descends to develop an unlocked state in which the engagement member 260 cannot be in contact with the main line movable rail 21.

At a time point when the actuator 271 halts, the connecting bar 34 of the connecting rod 32 is in a state in which it is not able to make a relative movement with the rod main body 33 to the (−) Y side but able to make a relative movement to the (+) Y side. That is, when the rod main body 33 moves further to the (+) Y side, the connecting bar 34 is in a state in which it is able to move to the (+) Y side in association with the movement. When the rod main body 33 moves further to the (+) Y side from this state, the connecting bar 34 moves to the (+) Y side in association with this movement. Therefore, the main line movable rail 21 connected via the supporting post 35 to the connecting bar 34 starts to move to the (+) Y side. Then, when the rod main body 33 moves further to the (+) Y side and the main line movable rail 21 is carried to the retracted position, the railroad switch 31 will halt.

Next, a description will be given of motion of the locking mechanism 250 when the main line movable rail 21 at the retracted position moves to the guide position.

In order to allow the main line movable rail 21 at the retracted position to move to the guide position, the railroad switch 31 is driven, by which the main line movable rail 21 moves to the (−) Y side together with the connecting rod 32. When the main line movable rail 21 is carried to the guide position, the driving switch 275 is in a state in which it is in contact with the contact end 37 which is formed on the rod main body 33 of the connecting rod 32.

When the driving switch 275 changes from a non-contact state to a contact state, the actuator 271 is driven, by which the driving rod 272 starts to ascend. The engagement member 260 will ascend in association with the ascent of the driving rod 272. With the ascent of the engagement member 260, the second piece portions 267 of the pair of projections 265 of the engagement member 260 are to be in contact with a lower end of the main line movable rail 21 and a lower end of the near-side main line rail (fixed rail) 11. Therefore, with the ascent of the engagement member 260, the second piece portions 267 of the pair of projections 265 of the engagement member 260 are pressed to the lower end of the main line movable rail 21 and the lower end of the near-side main line rail 11. Each of the projections 265 is decreased in interval between the ends of the first piece portions 266 of individual projections 265. Then, when the driving rod 272 of the actuator 271 ascends up to a position shown in FIGS. 11A to 11C, the engagement member 260 develops into the previously described locked state in which the first piece portions 266 of the projections 265 of the engagement member 260 are opposed individually to the pair of guide face 29 of the main line movable rail 21 at the guide position and the pair of guide faces 29 of the near-side main line rail 11.

In addition, in the present embodiment, unlike the First Embodiment so far described, as shown in FIG. 10A to FIG. 11C, the engagement member 260 in the locked state is engaged with both the main line movable rail 21 at the guide position and the near-side main line rail (fixed rail) 11. On the other hand, in the First Embodiment, the engagement member 110 in the locked state is engaged with only the main line movable rail 21 at the guide position. This is due to the fact that in the First Embodiment, the engagement member 110 as a whole moves rotationally around the shaft extending in the X direction in association with movement of the main line movable rail 21 in the Y direction and, therefore, when the engagement member 260 is engaged with the near-side main line rail 11 which is a fixed rail, rotational movement of the engagement member 110 is regulated by the near-side main line rail 11. On the other hand, the present embodiment is constituted in such a manner that while the main line movable rail 21 is present at the guide position and kept continuous to the near-side main line rail (fixed rail) 11, the engagement member 260 moves up and down and the projection 265 of the engagement member 260 is able to move rotationally. Thus, the engagement member 260 can be engaged with both the main line movable rail 21 at the guide position and the near-side main line rail (fixed rail) 11. That is, the locking mechanism 250 of the present embodiment constitutes an end locking mechanism which can be engaged with both the main line movable rail 21 at the guide position and the near-side main line rail (fixed rail) 11.

As described so far, in the present embodiment, since the engagement member 260 in the locked state is engaged with both the main line movable rail 21 at the guide position and the near-side main line rail (fixed rail) 11, it is possible to decrease a step formed at a joint between the second end 22 of the main line movable rail 21 at the guide position and the end 12 of the near-side main line rail (fixed rail) 11 and also improves ride quality when the track-based vehicle V passes through a branching section branching from the main line traveling lanes Ra, Rb to the branch line traveling lane Rc. In the present embodiment, the main line movable rail 21 at the guide position receives a force F from the guide wheels 5 of the track-based vehicle V on the near-side main line rail (fixed rail) 11 together with the engagement member 260. It is therefore possible to support more firmly the second end 22 of the main line movable rail 21 than in the First Embodiment.

As shown in FIG. 11A to FIG. 12C, in the present embodiment, even where a movable rail comes closer to the engagement member 260 from the (+) Y side or from the (−) Y side, the engagement member 260 can be engaged with the movable rail without any difficulty. Therefore, the engagement member 260 of the present embodiment can be engaged not only with the main line movable rail 21 but also with the branch line movable rail 25 when the main line movable rail 21 at the retracted position which is positioned on the (+) Y side comes closer to the engagement member 260 and also when the branch line movable rail 25 at the retracted position which is positioned on the (−) Y side comes closer thereto.

Therefore, as shown in FIG. 10, the locking mechanism 250 of the present embodiment acts not only as an end locking mechanism of the main line movable rail 21 but also as an end locking mechanism of the branch line movable rail 25. However, in this case, it is necessary that the actuator 271 is driven for the main line movable rail 21 which moves laterally on the (+) Y side and also for the branch line movable rail 25 which moves laterally on the (−) Y side on the basis of the engagement member 260. Therefore, in the present embodiment, as shown in FIG. 10, the rod main body 33 of the connecting rod 32*b* of the branch line movable rail 25 disposed at a position deviated in the X direction with respect to the connecting rod 32 of the main line movable rail 21 is provided with a contact end 37*b* which extends in the X direction so as to be in contact with the driving switch 275 as shown in FIGS. 11A to 11C.

As described so far, the locking mechanism 250 of the present embodiment acts not only as an end locking mechanism of the main line movable rail 21 but also as an end locking mechanism of the branch line movable rail 25. Therefore, where the main line movable rail 21 is present at the guide position and the branch line movable rail 25 is present at the retracted position, the locking mechanism 250 restrains the main line movable rail 21 at the guide position. Where the main line movable rail 21 is present at the retracted position and the branch line movable rail 25 is present at the guide position, the locking mechanism 250 restrains the branch line movable rail 25 at the guide position.

(Locking Mechanism of Third Embodiment)

Next, a detailed description will be given of a locking mechanism of a Third Embodiment by referring to FIG. 13A to FIG. 15C.

As shown in FIGS. 13A to 13C, a locking mechanism 550 of the present embodiment is a mechanism in which an engagement member 560 is allowed to move rotationally around a shaft extending in the Y direction, thereby activating the engagement member 560 so as to change between a locked state and an unlocked state. FIG. 13A shows the unlocked state, FIG. 13B shows a state in transition from the unlocked state to the locked state and FIG. 13C shows the locked state.

As shown in FIGS. 14A to 14C, the engagement member 560 is provided with a main body 561 and a pair of projections 565 fixed so as to face each other at an upper face of the main body 561. The upper face of the main body 561 forms a circular arc plane 562 around a shaft extending in the Y direction and the projections 565 are installed on both sides of the circular arc plane 562 in the Y direction. Each of FIG. 14A and FIG. 15A is a plan view of the locking mechanism 550, in a similar manner each of FIG. 14B and FIG. 15B is a front view of the locking mechanism 550 and each of FIGS. 14C and 15C is a side view of the locking mechanism 550.

A locking action mechanism 570 of the locking mechanism 550 is provided with an actuator 571 which rotates the engagement member 560 around a shaft extending in the Y direction and a driving switch 275 of the actuator 571. The actuator 571 is a driving source which activates the engagement member 560 so as to change.

The actuator 571 is provided with a rotational shaft 572 extending in the Y direction and a casing 573 which supports the rotational shaft 572 so as to be rotatable. The casing 573 of the actuator 571 is fixed via a bracket on a wall face or the like of a groove hole G in which the locking action mechanism 570 is disposed. The engagement member 560 is attached to the rotational shaft 572 of the actuator 571. The rotational shaft 572 of the actuator 571 is positioned on an extension line of a center axis of the circular arc plane 562 of the engagement member 560.

The rod main body 33 of the connecting rod 32 on a main line movable rail 21 is provided with a contact end 37 extending downward from the rod main body 33, as with the Second Embodiment and the like. A driving switch 275 is disposed at a position at which the main line movable rail 21 at the guide position is in contact with the contact end 37.

The rod main body 33 of the connecting rod 32*b* on the branch line movable rail 25 is provided with a contact end 37*b* which extends from the rod main body 33 in the X direction and can be in contact with the driving switch 275, as with the Second Embodiment and the like.

Next, a description will be given of motion of the locking mechanism 550 described so far.

First, a description will be given of a locked state of the engagement member 560 and a state of the locking action mechanism 570 at this time.

As shown in FIGS. 14A to 14C, the engagement member 560 in the locked state is such that projections 565 of the engagement member 560 are opposed individually to a pair of guide faces 29 of a second end 22 of the main line movable rail 21 at the guide position and a pair of guide faces 29 of an end 12 of a near-side main line rail (fixed rail) 11 continuous to the main line movable rail 21, and the second end 22 of the main line movable rail 21 and the end 12 of the near-side main line rail 11 are retained by the pair of projections 565. That is, the engagement member 560 is engaged with the second end 22 of the main line movable rail 21 at the guide position and also with the end 12 of the near-side main line rail 11 continuous to the second end 22, as with the Second Embodiment and the like.

The connecting bar 34 of the connecting rod 32 is in a state in which it is not able to make a relative movement with the rod main body 33 to the (+) Y side but able to make a relative movement to the (−) Y side. The driving switch 275 is in contact with the contact end 37 formed on the rod main body 33 of the connecting rod 32 on the main body movable rail.

It is assumed that the railroad switch 31 is driven for allowing the main line movable rail 21 to move to the retracted position from the above-described state and the rod main body 33 starts to move to the (+) Y side. At this time, the connecting bar 34 is able to remain there even if the rod main body 33 moves to the (+) Y side. Therefore, the main line movable rail 21 at the guide position which is connected via the supporting post 35 to the connecting bar 34 will not move. The rod main body 33 moves to the (+) Y side, by which the driving switch 275 is in a state in which it is not in contact with the contact end 37 formed on the rod main body 33.

When the driving switch 275 changes from a contact state to a non-contact state, the actuator 571 is driven, by which the rotational shaft 572 of the actuator 571 starts to rotate. As shown in FIGS. 15A to 15C, the engagement member 560 rotates around a shaft extending in the Y direction. Then, when the engagement member 560 rotates until the pair of projections 565 of the engagement member 560 are no longer opposed to the main line movable rail 21 at the guide position and the near-side main line rail (fixed rail) 11, the actuator 571 will halt. A state in which the pair of projections 565 are not opposed to the main line movable rail 21 at the guide position or the near-side main line rail (fixed rail) 11 is an unlocked state of the engagement member 560.

At a time point when the actuator 571 halts, the connecting bar 34 of the connecting rod 32 is in a state in which it is not able to make a relative movement with the rod main body 33 to the (−) Y side but able to make a relative movement to the (+) Y side. When the rod main body 33 moves further to the (+) Y side from this state, the connecting bar 34 moves to the (+) Y side in association with this movement. Thereby, the main line movable rail 21 connected via the supporting post 35 to the connecting bar 34 starts to move to the (+) Y side. Then, when the rod main body 33 moves further to the (+) Y side and the main line movable rail 21 is carried to the retracted position, the railroad switch 31 will halt.

Next, a description will be given of motion of the locking mechanism 550 when the main line movable rail 21 at the retracted position moves to the guide position.

In order to allow the main line movable rail 21 at the retracted position to move to the guide position, the railroad switch 31 is driven, by which the main line movable rail 21 moves to the (−) Y side together with the connecting rod 32. And, when the main line movable rail 21 is carried to the guide position, the driving switch 275 is in a state in which it is in contact with the contact end 37 formed on the rod main body 33 of the connecting rod 32.

When the driving switch 275 changes from a non-contact state to a contact state, the actuator 571 is driven, by which the engagement member 560 starts to rotate in a direction reverse to a previous direction. Then, when the pair of projections 565 of the engagement member 560 are opposed to the main line movable rail 21 at the guide position and the near-side main line rail (fixed rail) 11, that is, in the previously described locked state, the actuator 571 will halt.

As with the Second Embodiment and the like, the locking mechanism 550 of the present embodiment also acts not only as an end locking mechanism for the main line movable rail 21 but also as an end locking mechanism for the branch line movable rail 25. Therefore, in the present embodiment as well, where the main line movable rail 21 is at the guide position and the branch line movable rail 25 is at the retracted position, the main line movable rail 21 at the guide position is restrained. Where the main line movable rail 21 is at the retracted position and the branch line movable rail 25 is at the guide position, the branch line movable rail 25 at the guide position is restrained.

(Locking Mechanism of Fourth Embodiment)

Next, a detailed description will be given of a locking mechanism of a Fourth Embodiment by referring to FIG. 16A to FIG. 17C.

A locking mechanism 650 of the present embodiment is a mechanism in which, of a pair of projections 665, 665*a* of an engagement member 660, one projection 665 is allowed to move rotationally around a shaft extending in the Y direction, thereby activating the engagement member 660 so as to change between a locked state and an unlocked state. Each of FIG. 16A and FIG. 17A is a plan view of the locking mechanism 650, in a similar manner, each of FIG. 16B and FIG. 17B is a front view of the locking mechanism 650, and each of FIG. 16C and FIG. 17C is a side view of the locking mechanism 650.

The engagement member 660 is provided with a main body 661 formed in a rectangular solid shape and the pair of projections 665, 665*a*. The projections 665, 665*a* are individually installed at both ends of the rectangular-solid-shape main body 661 in the Y direction. Of the pair of projections 665, 665*a*, the projection 665 is attached to the main body 661 so as to rotate around a shaft in the Y direction. The projection 665*a* is fixed to the main body 661. The main body 661 of the engagement member 660 is fixed to a wall face inside a groove hole G in which the locking action mechanism 670 is disposed via a bracket or the like. In addition, the engagement member 660 is disposed at such a position that both a second end 22 of a main line movable rail 21 at the guide position and an end 12 of a near-side main line rail (fixed rail) 11 continuous to the second end 22 can be retained between the projections 665, 665*a*.

A locking action mechanism 670 of the locking mechanism 650 is provided with an actuator 571 which allows the projection 665 of the engagement member 660 to rotate around the shaft extending in the Y direction and a driving switch 275 of the actuator 571. The actuator 571 is a driving source which activates the engagement member 660 so as to change.

The actuator 571 is provided with a rotational shaft extending in the Y direction and a casing 273 which supports the rotational shaft so as to rotate. The casing 273 of the actuator 571 is fixed to a wall face or the like of the groove hole G in which the locking action mechanism 670 is disposed via a bracket. The projection 665 is fixed to the rotational shaft of the actuator 571.

Next, a description will be given of motion of the locking mechanism 650 which has been so far described.

First, a description will be given of a locked state of the engagement member 660 and a state of the locking action mechanism 670 at this time.

As shown in FIGS. 16A to 16C, the engagement member 660 in the locked state is such that the projections 665, 665*a* of the engagement member 660 are opposed individually to a pair of guide faces 29 of the second end 22 of the main line movable rail 21 at the guide position and a pair of guide faces 29 of the end 12 of the near-side main line rail (fixed rail) 11 continuous to the main line movable rail 21, and the second end 22 of the main line movable rail 21 and the end 12 of the near-side main line rail 11 are retained by the pair of projections 665, 665*a*. That is, as with the Second Embodiment and the like, the engagement member 660 is engaged with the second end 22 of the main line movable rail 21 at the guide position and also with the end 12 of the near-side main line rail 11 continuous to the second end 22.

The connecting bar 34 of the connecting rod 32 is in a state in which it is not able to make a relative movement with the rod main body 33 to the (+) Y side but able to make a relative movement to the (−) Y side. The driving switch 275 is in contact with the contact end 37 formed on the rod main body 33 of the connecting rod 32 on the main body movable rail.

It is assumed that in order to allow the main line movable rail 21 to move to the retracted position from the above state, a railroad switch 31 is driven and the rod main body 33 starts to move to the (+) Y side. At this time, the connecting bar 34 is able to remain there even if the rod main body 33 moves to the (+) Y side. Therefore, the main line movable rail 21 at the guide position which is connected to the connecting bar 34 via a supporting post 35 will not move. The rod main body 33 moves to the (+) Y side, by which the driving switch 275 is in a state in which it is not in contact with the contact end 37 formed on the rod main body 33.

When the driving switch 275 changes from a contact state to a non-contact state, the actuator 571 is driven and a rotational shaft of the actuator 571 starts to rotate. As shown in Fig. FIGS. 17A to 17C, the projection 665 of the engagement member 660 rotates around the shaft extending in the Y direction. Then, when the projection 665 of the engagement member 660 rotates until it is no longer opposed to the main line movable rail 21 at the guide position and the near-side main line rail (fixed rail) 11, the actuator 571 will halt. A state in which the projection 665 is no longer opposed to the main line movable rail 21 at the guide position or the near-side main line rail (fixed rail) 11 is an unlocked state of the engagement member 660.

At a time point when the actuator 571 halts, the connecting bar 34 of the connecting rod 32 is in a state in which it is not able to make a relative movement with the rod main body 33 to the (−) Y side but able to make a relative movement to the (+) Y side. When the rod main body 33 moves further to the (+) Y side from this state, the connecting bar 34 moves to the (+) Y side in association with this movement. Therefore, the main line movable rail 21 which is connected to the connecting bar 34 via the supporting post 35 starts to move to the (+) Y side. Then, when the rod main body 33 moves further to the (+) Y side and the main line movable rail 21 is carried to the retracted position, the railroad switch 31 will halt.

Next, a description will be given of motion of the locking mechanism 650 when the main line movable rail 21 at the retracted position moves to the guide position.

In order to allow the main line movable rail 21 at the retracted position to move to the guide position, the railroad switch 31 is driven, by which the main line movable rail 21 moves to the (−) Y side together with the connecting rod 32. And, when the main line movable rail 21 is carried to the guide position, the driving switch 275 is in a state in which it is in contact with the contact end 37 formed on the rod main body 33 of the connecting rod 32.

When the driving switch 275 changes from a non-contact state to a contact state, the actuator 571 is driven and the projection 665 of the engagement member 660 starts to rotate in a direction reverse to a previous direction. Then, when the pair of projections 665, 665*a* of the engagement member 660 face each other and also are opposed to the main line movable rail 21 at the guide position and the near-side main line rail (fixed rail) 11, that is, in the previously described locked state, the actuator 571 will halt.

(Locking Mechanism of Fifth Embodiment)

Next, a detailed description will be given of a locking mechanism of a Fifth Embodiment by referring to FIG. 18A to FIG. 22.

As shown in FIGS. 18A to 18C, a locking mechanism 750 of the present embodiment is a mechanism in which a pair of projections 765 of an engagement member 760 are allowed to move individually in the Y direction, by which the engagement member 760 is activated so as to change between a locked state and an unlocked state. FIG. 18A shows an unlocked state, FIG. 18B shows a state in transition from the unlocked state to a locked state, and FIG. 18C shows the locked state.

As shown in FIGS. 19A to 19C, the engagement member 760 of the present embodiment is provided with the pair of projections 765 which are mutually independent. Each of the projections 765 is identical in shape and each of the projections 765 is provided with an opposing face 766 perpendicular in the Y direction and opposite to a guide face 29 of a main line movable rail 21 and an inclined face 767 inclined with respect to the opposing face 766. The inclined face 767 is inclined downward as moving in a direction away from the opposing face 766 in the Y direction. Each of FIG. 19A through FIG. 12A is a plan view of the locking mechanism 750, in a similar manner, each of FIG. 19B through FIG. 21B is a front view of the locking mechanism 750, and each of FIG. 19A to FIG. 20C is a side view of the locking mechanism 750.

A locking action mechanism 770 of the locking mechanism 750 is provided with an inclined movement guide member 771, an elliptic cylinder-shaped cam 773, a cam follower 775, a coupling link member 776, a cam follower spring (elastic body) 777, a rotary force-transmitting member 778, a first projection body 781, a second projection body 783, and a projection body-supporting member 785. The inclined movement guide member 771 is provided with an inclined face 772 which is in contact in a sliding manner with the inclined face 767 of the projection 765. The cam follower 775 is in contact with a cam surface 774 of the cam 773 corresponding to an elliptic cylinder-shaped side circumferential face, and the coupling link member 776 connects the cam follower 775 with the projection 765. The cam follower spring 777 urges the cam follower 775 in a direction in contact with the cam surface 774. The rotary force-transmitting member 778 is fixed on the cam surface 774 of the cam 773. When the rod main body 33 of the connecting rod 32 moves to the (+) Y side, the first projection body 781 pushes an end of the rotary force-transmitting member 778 to the (+) Y side in association with this movement. When the rod main body 33 of the connecting rod 32 moves to the (−) Y side, the second projection body 783 pushes the end of the rotary force-transmitting member 778 to the (−) Y side in association with this movement. The projection body-supporting member 785 supports the first projection body 781 and the second projection body 783.

The cam 773 is disposed below a joint between a second end 22 of the main line movable rail 21 at the guide position and an end 12 of a near-side main line rail 11 continuous to the second end. The cam 773 is supported so as to be rotatable by a bearing 788 which is fixed on a bottom face and the like inside a groove hole G in which the locking action mechanism 770 is disposed.

Each of the pair of projections 765 is provided with the inclined movement guide member 771, the cam follower 775, the coupling link member 776 and the cam follower spring 777. The inclined movement guide member 771 is disposed both on the (+) Y side and (−) Y side on the basis of a rotational center shaft of the cam 773 and fixed on a wall face inside the groove hole G in which the locking action mechanism 770 is disposed via a bracket or the like. An inclined face 772 of each inclined movement guide member 771 is inclined downward as moving in a direction away from the corresponding inclined movement guide member 771 in the Y direction.

The cam follower 775 is installed so as to rotate with respect to a cam follower shaft 789 extending in the X direction. One end of the cam follower 775 forms a contact end which is in contact with the cam 773. The other end of the cam follower 775 is coupled with the inclined movement guide member 771 by the coupling link member 776. The other end of the cam follower 775 is connected with the coupling link member 776 by using a pin, and the coupling link member 776 is connected with the inclined movement guide member 771 by using a pin.

The rotary force-transmitting member 778 protrudes in a radial direction from the cam surface 774 of the cam 773.

The projection body-supporting member 785 is fixed to the rod main body 33 of the connecting rod 32. A spring 39 for urging a connecting bar 34 from the (−) Y side, that is, from the rod main body 33 to a projecting side is installed inside the rod main body 33 of the connecting rod 32.

As shown in FIG. 22, the second projection body 783 is fixed to the projection body-supporting member 785. A face of the second projection body 783 on the (−) Y side forms a second pressing face 784 parallel in the Z direction.

The first projection body 781 is disposed, with an interval kept from the second projection body 783 to the (−) Y side, and attached to the projection body-supporting member 785 so as to rotate around a shaft extending in the X direction. The (+) Y side of the first projection body 781 forms the first pressing face 782. In the first projection body 781, a part which is on the side of the pressing face 782 with respect to the rotating shaft is urged to a (+) Z side by a spring (elastic body) for the projection body 142.

In the present embodiment, a conversion unit is provided with the inclined movement guide member 771, the cam 773, the cam follower 775, the coupling link member 776, the cam follower spring 777, the rotary force-transmitting member 778, the first projection body 781, the second projection body 783 and the projection body-supporting member 785 and converts a lateral driving force of the switching mechanism 30 to a driving force for activating the engagement member 760 so as to change.

Next, a description will be given of motion of the locking mechanism 750 which has been so far described.

First, a description will be given of a locked state of the engagement member 760 and a state of the locking action mechanism 770 at that time.

As shown in FIGS. 19A to 19C, the engagement member 760 in the locked state is such that opposing faces 766 of the projections 765 of the engagement member 760 are opposed individually to a pair of guide faces 29 at the second end 22 of the main line movable rail 21 at the guide position and a pair of guide faces 29 at an end of the near-side main line rail (fixed rail) 11 continuous to the main line movable rail 21, and the second end 22 of the main line movable rail 21 and the end 12 of the near-side main line rail 11 are retained by the pair of projections 765. That is, as with the Second Embodiment and the like, the engagement member 760 is engaged with the second end 22 of the main line movable rail 21 at the guide position and also with the end 12 of the near-side main line rail 11 continuous to the second end 22. At this time, an interval between the opposing faces 766 of the pair of projections 765 is made minimum and substantially equal to an interval between the pair of guide faces 29 of the main line movable rail 21.

The contact end of the cam follower 775 is in contact with a point at which a longer axis of the elliptic cylinder-shaped cam 773 intersects with the cam surface 774 which is an outer circumferential face thereof. Therefore, an interval between the contact ends 37 of the pair of cam followers 775 is made maximum. An end of the rotary force-transmitting member 778 is positioned between the first pressing face 782 of the first projection body 781 and the second pressing face 784 of the second projection body 783. The connecting bar 34 of the connecting rod 32 is in a state in which it is not able to make a relative movement with the rod main body 33 to the (+) Y side but able to make a relative movement to the (−) Y side.

It is assumed that in order to allow the main line movable rail 21 to move to the retracted position from the above-described state, the railroad switch 31 is driven and, as shown in FIGS. 20A to 20C, the rod main body 33 starts to move to the (+) Y side. At this time, the connecting bar 34 is able to remain there even if the rod main body 33 moves to the (+) Y side. Therefore, the main line movable rail 21 at the guide position which is connected to the connecting bar 34 via the supporting post 35 will not move. The rod main body 33 moves to the (+) Y side, by which the first projection body 781 and the second projection body 783 attached to the rod main body 33 via the projection body-supporting member 785 also move to the (+) Y side. When the first projection body 781 and the second projection body 783 move to the (+) Y side, an end of the rotary force-transmitting member 778 positioned between the first projection body 781 and the second projection body 783 is pushed by the first pressing face 782 of the first projection body 781 and moves to the (+) Y side.

When the end of the rotary force-transmitting member 778 moves to the (+) Y side, the cam 773 rotates around the rotational center shaft thereof. Due to this rotation, an interval between the contact ends 37 of the pair of cam followers 775 in contact with the cam surface 774 is gradually decreased, while an interval between the other ends of the pair of cam followers 775 is increased. Therefore, there is increased an interval between the projections 765, each of which is connected via the coupling link member 776 to the other end of each cam follower 775. More specifically, on the basis of the rotational center shaft of the cam 773, the projection 765 disposed on the (+) Y side moves to the (+) Y side, and the projection 765 disposed on the (−) Y side moves to the (−) Y side. At this time, each of the projections 765 moves in the Y direction, while the inclined face 767 thereof is in contact in a sliding manner with an inclined face 767 of the inclined movement guide member 771. Therefore, each of the projections 765 moves downward in association with movement in the Y direction. Then, when the pair of projections 765 moves downward to an extent that they are no longer opposed to the main line movable rail 21 at the guide position or the near-side main line rail (fixed rail) 11, as shown in FIGS. 21A to 21B, an end of the rotary force-transmitting member 778 comes out between the first projection body 781 and the second projection body 783, and the cam 773 will not rotate, by which the pair of projections 765 will halt. A state in which the pair of projections 765 is no longer opposed to the main line movable rail 21 at the guide position or the near-side main line rail (fixed rail) 11 is an unlocked state of the engagement member 760.

When the engagement member 760 halts, the connecting bar 34 of the connecting rod 32 is in a state in which it is not able to make a relative movement with the rod main body 33 to the (−) Y side but able to make a relative movement to the (+) Y side.

When the rod main body 33 moves further to the (+) Y side from this state, the connecting bar 34 moves to the (+) Y side in association with this movement. Therefore, the main line movable rail 21 connected to the connecting bar 34 via the supporting post 35 starts to move to (+) Y side. Then, when the rod main body 33 moves further to the (+) Y side and the main line movable rail 21 is carried to the retracted position, the railroad switch 31 will halt.

Next, a description will be given of motion of the locking mechanism 750 during which the main line movable rail 21 at the retracted position moves to the guide position.

When the main line movable rail 21 is at the retracted position, as shown in FIGS. 21A and 21B, the connecting bar 34 of the connecting rod 32 for the main line movable rail 21 is in a state in which the connecting bar 34 projects against the rod main body 33 to a maximum extent due to an urging force from a spring 39 inside the rod main body 33, that is, a state in which a position relative to the rod main body 33 is at the (−) Y position to the greatest extent. Therefore, the first projection body 781 and the second projection body 783 attached to the rod main body 33 are to be positioned further to the (+) Y side than in a state shown in FIGS. 19A to 19C with respect to the main line movable rail 21 connected to the connecting bar 34 via the supporting post 35.

Therefore, the railroad switch 31 is driven for allowing the main line movable rail 21 to move to the guide position, the main line movable rail 21 moves to the (−) Y side together with the connecting rod 32. Even when the main line movable rail 21 is carried to the guide position, the first projection body 781 and the second projection body 783 attached on the rod main body 33 are not yet at such a position that an end of the rotary force-transmitting member 778 can completely enter between them.

When a switching device is driven to move the rod main body 33 further to the (−) Y side, the first projection body 781 and the second projection body 783 attached to the rod main body 33 are in a state in which the end of the rotary force-transmitting member 778 starts to enter between them and the end of the rotary force-transmitting member 778 starts to be pushed to the (−) Y side by the second pressing face 784 of the second projection body 783. When the end of the rotary force-transmitting member 778 starts to move to the (−) Y side, the cam 773 starts to rotate in a direction reverse to a previous direction. The pair of projections 765 moves upward, while moving in a direction at which an interval between them is decreased. Then, when the opposing faces 766 of the pair of projections 765 are opposed to the guide face 29 of the main line movable rail 21 at the guide position and the guide face 29 of the near-side main line rail (fixed rail) 11, that is, in the previously described locked state, the railroad switch 31 will halt and the pair of projections 765 will also halt.

(Locking Mechanism of Modified Embodiment)

In the locking mechanism 100 of the First Embodiment, the regulation member 130 is allowed to move in the Y direction, by which the engagement member 110 is activated so as to change between the locked state and the unlocked state.

However, it is acceptable that in the First Embodiment, the regulation member is allowed to move in the X direction by using the actuator and the engagement member 110 is activated so as to change between the locked state and the unlocked state. It is also acceptable that in the First Embodiment, the regulation member is allowed to move in the Z direction by using an actuator and the engagement member

110 is activated so as to change between the locked state and the unlocked state. It is also acceptable that in the First Embodiment, the regulation member is allowed to move rotationally around a shaft extending in the X direction by using the actuator and the engagement member 110 is activated so as to change between the locked state and the unlocked state. It is also acceptable that in the First Embodiment, the regulation member is allowed to move rotationally around a shaft extending in the Y direction by using the actuator and engagement member 110 is activated so as to change between the locked state and the unlocked state.

Regarding the pair of projections described in the First Embodiment to Seventeenth Embodiment, an elastic material may be installed on only one projection or both of the projections.

In the locking mechanisms described in the individual embodiments, as shown in FIG. 2, where the branch line movable rail 25 which is curved (a curved part 25*a*) is retained between a pair of projections and where the branch line movable rail 25 at the guide position is retained by these projections, it is preferable that a face opposing to the branch line movable rail 25 is curved at such a curvature that is in agreement with a curvature of the curved part 25*a* of the branch line movable rail 25. As described above, if the branch line movable rail 25 is retained, the face of the projection opposing the branch line movable rail 25 is curved at a curvature in agreement with a curvature of the curved part 25*a* of the branch line movable rail 25, it is possible to make substantially equal a clearance between projections at each position of the guide face 29 of the branch line movable rail 25 and also decrease the clearance between them.

The above description has been given by referring to the branch line movable rail 25 as an example. Where the main line movable rail 21 is curved, it is similarly preferable that a face of the projection opposing the guide face 29 of the main line movable rail 21 is curved at a curvature in agreement with a curvature of the main line movable rail 21.

In order to cope with the main line movable rail 21 and the branch line movable rail 25 which are curved, it is acceptable that a part including a face of the projection opposing the guide face 29 of the main line movable rail 21 or the guide face 29 of the branch line movable rail 25 is formed with an elastic material. As described above, a part of the projection is formed with an elastic material, by which even where the main line movable rail 21 or the branch line movable rail 25 is curved and where as described previously, the main line movable rail 21, the branch line movable rail 25 and the like are great in manufacturing error, at least a part of the elastic material is in contact with the main line movable rail 21 or the branch line movable rail 25 to undergo elastic deformation. It is thereby possible to cope with a curved rail, manufacturing error and the like.

The invention claimed is:

1. A branching device for guiding a track-based vehicle traveling between fixed rails in a track-based transportation system, the transportation system being equipped with a traveling lane and the fixed rails disposed so as to sandwich a branching section at a center of the traveling lane in a traveling lane width direction, the branching device comprising:

a movable rail having a first end positioned at a position continuous to one of the fixed rails, which is supported so as to swing around the first end, and which is switchable between a guide position at which a second end of the movable rail opposite to the first end is continuous to another of the fixed rails and a retracted position at which the second end has a different position from the another of the fixed rails in the traveling lane width direction;

a pivotable engagement member configured to be engaged with the movable rail at the guide position, and the pivotable engagement member capable of changing a position thereof between a locked state in which the movable rail sits in an upper recess formed on the pivotable engagement member at the guide position and an unlocked state in which the engagement member is released from the movable rail; and a switching section configured to move the moveable rail between the guide position and the retracted position, and to have the engagement member engage with the moveable rail while moving the movable rail toward the guide position.

2. The branching device according to claim 1, wherein the engagement member is supported so as to move rotationally around a rotational axis parallel to a direction from the one of the fixed rails to the another of the fixed rails, and the recess is formed between a pair of projections which are able to retain the movable rail at the guide position in the traveling lane width direction, and wherein the engagement member is supported rotationally around the rotational axis, and is capable of changing the position thereof between the locked state in which the engagement member is engaged with the movable rail by retaining the movable rail between the pair of projections and the unlocked state in which the engagement member is released from the movable rail by retracting the pair of projections from the movable rail.

3. The branching device according to claim 2, wherein at least one of the projections of the engagement member is such that a part thereof including a face opposing the movable rail in the locked state is formed of an elastic material.

4. The branching device according to claim 2, wherein at least a part of the movable rail retained between the pair of projections at the guide position is formed as a curved part, and the pair of projections of the engagement member is such that faces opposing the movable rail on retaining the movable rail positioned at the guide position are curved at a curvature in accordance with a curvature of the curved part.

5. The branching device according to claim 1, wherein the engagement member is a plurality of the engagement members and the plurality of engagement members are disposed along the movable rail positioned at the guide position.

6. The branching device according to claim 1, wherein the traveling lane is provided with a main line traveling lane and a branch line traveling lane which branches from the main line traveling lane, the another of the fixed rails is a near-side main line rail which is a fixed rail of the main line traveling lane disposed on a near side in a traveling direction from a branch starting position at which the branch line traveling lane starts to branch from the main line traveling lane, one of the fixed rails includes a forward-side main line rail which is a fixed rail of the main line traveling lane disposed via the branching section from the near-side main line rail along the main line traveling lane and a branch line rail which is a fixed rail of the branch line traveling lane disposed via the branching section from the main line traveling lane along the branch line traveling lane, the movable rail is provided with a main line movable rail disposed at a position at which the first end is continuous to the forward-side main line rail and a branch line movable rail disposed at a position at which the first end is continuous to the branch line rail, the engagement member is a plurality of the engagement members, and the engagement members are installed on the main line movable rail and the branch line movable rail.

7. A track-based transportation system comprising:

the branching device according to claim 1;

the traveling lane; and the fixed rails.

8. The branching device according to claim 1, further comprising a regulation member configured to be capable of contacting a lower face of the engagement member to restrain the movable rail, wherein the movable rail is maintained in the locked state while the regulation member is contacting the lower face of the engagement member.

* * * * *